US010721577B2

(12) United States Patent
Nakano

(10) Patent No.: US 10,721,577 B2
(45) Date of Patent: Jul. 21, 2020

(54) ACOUSTIC SIGNAL PROCESSING APPARATUS AND ACOUSTIC SIGNAL PROCESSING METHOD

(71) Applicant: SONY CORPORATION, Tokyo (JP)

(72) Inventor: Kenji Nakano, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/542,764

(22) PCT Filed: Jan. 15, 2016

(86) PCT No.: PCT/JP2016/051073
§ 371 (c)(1),
(2) Date: Jul. 11, 2017

(87) PCT Pub. No.: WO2016/121519
PCT Pub. Date: Aug. 4, 2016

(65) Prior Publication Data

US 2018/0007485 A1 Jan. 4, 2018

(30) Foreign Application Priority Data

Jan. 29, 2015 (JP) ..... 2015-015540

(51) Int. Cl.
*H04R 5/00* (2006.01)
*H04S 5/02* (2006.01)
(Continued)

(52) U.S. Cl.
CPC ..... *H04S 5/02* (2013.01); *H04R 5/02* (2013.01); *H04S 5/00* (2013.01); *H04S 7/302* (2013.01);
(Continued)

(58) Field of Classification Search
CPC .. G10L 19/008; G10H 1/16; G10H 2210/005; H03G 3/00; H04S 3/00; H04S 3/02;
(Continued)

(56) References Cited

U.S. PATENT DOCUMENTS 4,199,658 A * 4/1980 Iwahara ..... H04S 1/002 381/303
6,442,277 B1 * 8/2002 Lueck ..... H04S 5/00 381/1
(Continued)

FOREIGN PATENT DOCUMENTS

JP 2001-069599 A 3/2001
JP 2012-054669 A 3/2012
(Continued)

OTHER PUBLICATIONS

International Search Report and Written Opinion of PCT Application No. PCT/JP2016/051073, dated Feb. 16, 2016, 01 pages of English Translation and 06 pages of ISRWO.

*Primary Examiner* — Leshui Zhang
(74) *Attorney, Agent, or Firm* — Chip Law Group

(57) ABSTRACT

The present technology relates to an acoustic signal processing apparatus, an acoustic signal processing method, and a program for expanding a range of listening positions in which an effect of a transaural reproduction system can be obtained. First and second output signals for localizing a sound image in front of or behind and on the left of a first position located on the left of a listening position are output from first and second speakers, respectively. Third and fourth output signals for localizing a sound image in front of or behind and on the right of a second position located on the right of the listening position are output from third and fourth speakers, respectively. The first speaker is disposed in a first direction in front of or behind the listening position and on the left of the listening position. The second speaker
(Continued)

is disposed in the first direction and on the right of the listening position. The third speaker is disposed in the first direction and on the left of the listening position and on the right of the first speaker. The fourth speaker is disposed in the first direction of the listening position and on the right of the second speaker. The present technology can be applied, for example, to an acoustic processing system.

10 Claims, 16 Drawing Sheets

(51) Int. Cl.
*H04S 7/00* (2006.01)
*H04S 5/00* (2006.01)
*H04R 5/02* (2006.01)

(52) U.S. Cl.
CPC ..... *H04S 7/303* (2013.01); *H04S 2400/01* (2013.01); *H04S 2400/11* (2013.01); *H04S 2420/01* (2013.01)

(58) Field of Classification Search
CPC . H04S 1/002; H04S 1/005; H04S 7/00; H04S 7/30; H04S 7/301; H04S 5/02; H04S 5/005; H04S 2420/01; H04S 2420/03; H04S 2420/05; H04S 2420/07; H04S 2420/11; H04S 2420/13; H04S 7/302; H04S 7/303; H04S 7/305; H04S 7/307; H04S 7/308; H04S 2400/01; H04S 2400/03; H04S 2400/05; H04S 2400/07; H04S 2400/09; H04S 2400/11; H04S 2400/13; H04S 2400/15; H04R 5/00; H04R 5/005; H04R 5/02; H04R 5/033; H04R 2203/00; H04R 3/00; H04R 3/002; H04R 3/005; H04R 3/007; H04R 3/02; H04R 3/04; H04R 3/06; H04R 3/08; H04R 3/10; H04R 3/12; H04R 3/14; H04R 19/013; H04R 19/02; H04R 11/00; H04R 11/02; H04R 9/00
USPC ..... 381/1, 21, 22, 23, 27, 17, 18, 19, 302, 381/303, 306, 307, 310, 311, 61, 119, 381/111, 116, 117, 118; 700/94
See application file for complete search history.

(56) References Cited

U.S. PATENT DOCUMENTS

| | | | | |
|---|---|---|---|---|
| 2009/0123007 | A1* | 5/2009 | Katayama | H04S 7/302 381/300 |
| 2015/0215721 | A1* | 7/2015 | Sato | H04S 3/002 381/307 |

FOREIGN PATENT DOCUMENTS

| | | | | |
|---|---|---|---|---|
| JP | 2012054669 | A * | 3/2012 | |
| JP | 2013-110682 | A | 6/2013 | |
| WO | WO-2014034555 | A1 * | 3/2014 | H04S 3/002 |

* cited by examiner 101
111
ACOUSTIC SIGNAL PROCESSING UNIT
121
TRANSAURAL PROCESSING UNIT
131
BINAURALIZATION PROCESSING UNIT
132
CROSSTALK COMPENSATION PROCESSING UNIT
122
OUTPUT CONTROL UNIT
SLin
SRin
BINAURAL SIGNAL GENERATING UNIT
141LL
141LR
141RL
141RR
BLL
BLR
BRL
BRR
f1 (G1L, G2L)
f2 (G1L, G2L)
f1 (G1R, G2R)
f2 (G1R, G2R)
151LL
152LL
SLL1
SLL2
151LR
152LR
SLR1
SLR2
151RL
152RL
SRL1
SRL2
151RR
152RR
SRR1
SRR2
153LL
153LR
153RL
153RR
SLLout
SLRout
SRLout
SRRout
112LL
112RL
112LR
112RR

ACOUSTIC SIGNAL PROCESSING APPARATUS AND ACOUSTIC SIGNAL PROCESSING METHOD

CROSS REFERENCE TO RELATED APPLICATIONS

This application is a U.S. National Phase of International Patent Application No. PCT/JP2016/051073 filed on Jan. 15, 2016, which claims priority benefit of Japanese Patent Application No. JP 2015-015540 filed in the Japan Patent Office on Jan. 29, 2015. Each of the above-referenced applications is hereby incorporated herein by reference in its entirety.

TECHNICAL FIELD

The present technology relates to an acoustic signal processing apparatus, an acoustic signal processing method, and a program, and more particularly, to an acoustic signal processing apparatus, an acoustic signal processing method, and a program for expanding a range of listening positions in which an effect of transaural reproduction system can be obtained.

BACKGROUND ART

A method of reproducing sound recorded with microphones arranged around both ears through a headphone is known as a binaural recording/reproduction system. A two-channel signal recorded by the binaural recording is referred to as a binaural signal, which contains acoustic information on a position of a sound source in a lateral direction, and in an up-down direction and a front-back direction as well, to a human. Moreover, a method of reproducing this binaural signal using the two-channel speakers on the left side and the right side, instead of using the headphone, is referred to as a transaural reproduction system (e.g., see Patent Document 1).

CITATION LIST

Patent Document

Patent Document 1: Japanese Patent Application Laid-Open No. 2013-110682

SUMMARY OF THE INVENTION

Problems to be Solved by the Invention

The range of listening positions, however, in which the effect of the transaural reproduction system can be obtained is very narrow. The range is particularly narrow in the lateral direction, so that the effect of the transaural reproduction system is significantly decreased if a listener is deviated only slightly to the right or left from an ideal listening position.

The present technology, therefore, expands the range of listening positions in which the effect of the transaural reproduction system can be obtained.

Solutions to Problems

An acoustic signal processing apparatus according to a first aspect of the present technology includes a transaural processing unit configured to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, the transaural processing unit configured to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and an output control unit configured to output the first output signal to the first speaker, output the second output signal to the second speaker, output the third output signal to the third speaker, and output the fourth output signal to the fourth speaker.

The first to fourth speakers can further be provided.

A distance between the first and second speakers can be substantially equal to a distance between the third and fourth speakers.

The first to fourth speakers can be arranged substantially linearly in a lateral direction with respect to the listening position.

An acoustic signal processing method according to the first aspect of the present technology, includes executing transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, executing transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and executing output control to output the first output signal to the first speaker, output the second output signal to the second speaker, output the third output signal to the third speaker, and output the fourth output signal to the fourth speaker.

A program according to the first aspect of the present technology is a program for causing a computer to execute transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and output control to output the first output signal to the first speaker, output the second output signal to the second speaker, output the third output signal to the third speaker, and output the fourth output signal to the fourth speaker.

An acoustic signal processing apparatus according to a second aspect of the present technology, includes a transaural processing unit configured to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, the transaural processing unit configured to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and an output control unit configured to output the first output signal to the first speaker, output a mixed signal of the second output signal and the third output signal to the second speaker, and output the fourth output signal to the third speaker.

The first to third speakers can further be provided.

A distance between the first and second speakers can be substantially equal to a distance between the second and third speakers.

The first to third speakers can be arranged substantially linearly in a lateral direction with respect to the listening position.

An acoustic signal processing method according to the second aspect of the present technology, includes executing transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, executing transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and executing output control to output the first output signal to the first speaker, output a mixed signal of the second output signal and the third to the second speaker, and output the fourth output signal to the third speaker.

A program according to the second aspect of the present technology is a program for causing a computer to execute transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and output control to output the first output signal to the first speaker, output a mixed signal of the second output signal and the third output signal to the second speaker, and output the fourth output signal to the third speaker.

An acoustic signal processing apparatus according to a third aspect of the present technology, includes a first speaker disposed in a first direction in front of or behind a predetermined listening position and on the left of the listening position, a second speaker disposed in the first direction and on the right of the listening position, a third speaker disposed in the first direction and on the left of the listening position, and on the right of the first speaker, and a fourth speaker disposed in the first direction of the listening position and on the right of the second speaker, in which the acoustic signal processing apparatus generates a first output signal for a left side speaker and a second output signal for a right side speaker by carrying out transaural processing on a first acoustic signal, the transaural processing including localizing a sound image from sound from the first speaker and the second speaker, with respect to a first position located on the left of the listening position, in a second direction in front of or behind the first position and on the left of the first position, and outputs sound in accordance with the first output signal from the first speaker among the first output signal for the left side speaker and the second output signal for the right side speaker, outputs sound in accordance with the second output signal from the second speaker, generates a third output signal for a left side speaker and a fourth output signal for a right side speaker generated by carrying out transaural processing on a second acoustic signal, the transaural processing localizing a sound image from sound from the third speaker and the fourth speaker, with respect to a second position located on the right of the listening position, in a third direction in front of or behind the second position and on the right of the second position, and outputs sound in accordance with the third output signal from the third speaker among the third output signal for the left side speaker and the fourth output signal for the right side speaker, and outputs sound in accordance with the fourth output signal from the fourth speaker.

A distance between the first and second speakers can be substantially equal to a distance between the third and fourth speakers.

The first to fourth speakers can be arranged substantially linearly in a lateral direction with respect to the listening position.

An acoustic signal processing method according to the third aspect of the present technology includes disposing a first speaker in a first direction in front of or behind a predetermined listening position and on the left of the listening position, disposing a second speaker in the first direction and on the right of the listening position, disposing a third speaker in the first direction and on the left of the listening position, and on the right of the first speaker, and disposing a fourth speaker in the first direction of the listening position and on the right of the second speaker, generating a first output signal for a left side speaker and a second output signal for a right side speaker by carrying out transaural processing on a first acoustic signal, the transaural processing including localizing a sound image from sound from the first speaker and the second speaker, with respect to a first position located on the left of the listening position, in a second direction in front of or behind the first position and on the left of the first position, and outputting sound in accordance with the first output signal from the first speaker among the first output signal for the left side speaker and the second output signal for the right side speaker, outputting sound in accordance with the second output signal from the second speaker, generating a third output signal for a left side speaker and a fourth output signal for a right side speaker generated by carrying out transaural processing on a second acoustic signal, the transaural processing localizing a sound image from sound from the third speaker and the fourth speaker, with respect to a second position located on the right of the listening position, in a third direction in front of or behind the second position and on the right of the second position, and outputting sound in accordance with the third output signal from the third speaker among the third output signal for the left side speaker and the fourth output signal for the right side speaker, and outputting sound in accordance with the fourth output signal from the fourth speaker.

An acoustic signal processing apparatus according to a fourth aspect of the present technology includes a first speaker disposed in a first direction in front of or behind a predetermined listening position and on the left of the listening position, a second speaker disposed in the first direction of the listening position and substantially in front of or substantially behind the listening position, and a third speaker disposed in the first direction and on the right of the listening position, in which the acoustic signal processing apparatus generates a first output signal for a left side speaker and a second output signal for a right side speaker by carrying out transaural processing on a first acoustic signal, the transaural processing including localizing a sound image from sound from the first speaker and the second speaker, with respect to a first position located on the left of the listening position, in a second direction in front of or behind the first position and on the left of the first position, and outputs sound in accordance with the first output signal from the first speaker among the first output signal for the left side speaker and the second output signal for the right side speaker, generates a third output signal for a left side speaker and a fourth output signal for a right side speaker generated by carrying out transaural processing on a second acoustic signal, the transaural processing localizing a sound image from sound from the second speaker and the third speaker, with respect to a second position located on the right of the listening position, in a third direction in front of or behind the second position and on the right of the second position, and outputs sound in accordance with the fourth output signal from the third speaker among the third output signal for the left side speaker and the fourth output signal for the right side speaker, and outputs sound in accordance with a mixed signal of the second output signal and the third output signal from the second speaker.

A distance between the first and second speakers can be substantially equal to a distance between the second and third speakers.

The first to third speakers can be arranged substantially linearly in a lateral direction with respect to the listening position.

An acoustic signal processing method according to the fourth aspect of the present technology includes disposing a first speaker in a first direction in front of or behind a predetermined listening position and on the left of the listening position, disposing a second speaker in the first direction of the listening position and substantially in front of or substantially behind the listening position, and disposing a third speaker in the first direction and on the right of the listening position, generating a first output signal for a left side speaker and a second output signal for a right side speaker by carrying out transaural processing on a first acoustic signal, the transaural processing including localizing a sound image from sound from the first speaker and the second speaker, with respect to a first position located on the left of the listening position, in a second direction in front of or behind the first position and on the left of the first position, and outputting sound in accordance with the first output signal from the first speaker among the first output signal for the left side speaker and the second output signal for the right side speaker, generating a third output signal for a left side speaker and a fourth output signal for a right side speaker generated by carrying out transaural processing on a second acoustic signal, the transaural processing localizing a sound image from sound from the second speaker and the third speaker, with respect to a second position located on the right of the listening position, in a third direction in front of or behind the second position and on the right of the second position, and outputting sound in accordance with the fourth output signal from the third speaker among the third output signal for the left side speaker and the fourth output signal for the right side speaker, and outputting sound in accordance with a mixed signal of the second output signal and the third output signal from the second speaker.

According to the first aspect of the present technology, the first output signal for the left side speaker and the second output signal for the right side speaker are generated by carrying out the transaural processing on the first acoustic signal, the transaural processing including localizing, with respect to the first position located on the left of the predetermined listening position, the sound image from the first speaker disposed in the first direction in front of or behind the listening position and on the left of the listening position, and the sound image from the second speaker disposed in the first direction and on the right of the listening position, in the second direction in front of or behind the first position and on the left of the first position, the third output signal for the left side speaker and the fourth output signal for the right side speaker are generated by carrying out transaural processing on the second acoustic signal, the transaural processing including localizing, with respect to the second position located on the right of the listening position, the sound image from the third speaker disposed in the first direction and on the left of the listening position and disposed on the right of the first speaker, and the sound image from a fourth speaker disposed in the first direction of the listening position and on the right of the second speaker, in the third direction in front of or behind the second position and on the right of the second position, and the first output signal is output to the first speaker, the second output signal is output to the second speaker, the third output signal is output to the third speaker, and the fourth output signal is output to the fourth speaker.

According to the second aspect of the present technology, the first output signal for the left side speaker and the second output signal for the right side speaker are generated by carrying out the transaural processing on the first acoustic signal, the transaural processing including localizing, with respect to the first position located on the left of the predetermined listening position, the sound image from the first speaker disposed in the first direction in front of or behind the listening position and on the left of the listening position, and the sound image from the second speaker disposed in the first direction and on the right of the listening position, in the second direction in front of or behind the first position and on the left of the first position, the third output signal for the left side speaker and the fourth output signal for the right side speaker are generated by carrying out the transaural processing on the second acoustic signal, the transaural processing including localizing, with respect to the second position located on the right of the listening position, the sound image from the third speaker disposed in the first direction and on the left of the listening position and disposed on the right of the first speaker, and the sound image from the fourth speaker disposed in the first direction of the listening position and on the right of the second speaker, in the third direction in front of or behind the second position and on the right of the second position, and the first output signal is output to the first speaker, the mixed signal of the second output signal and the third output signal is output to the second speaker, and the fourth output signal is output to the third speaker.

According to the third aspect of the present technology, the first speaker is disposed in the first direction in front of or behind the predetermined listening position and on the left of the listening position, the second speaker is disposed in the first direction and on the right of the listening position, the third speaker is disposed in the first direction and on the left of the listening position, and on the right of the first speaker, and the fourth speaker is disposed in the first direction of the listening position and on the right of the second speaker, in which the first output signal for the left side speaker and the second output signal for the right side speaker are generated by carrying out the transaural processing on the first acoustic signal, the transaural processing including localizing, with respect to the first position located on the left of the listening position, the sound image from the sound from the first speaker and the second speaker in the second direction in front of or behind the first position and on the left of the first position, and the sound in accordance with the first output signal is output from the first speaker among the first output signal for the left side speaker and the second output signal for the right side speaker, the sound in accordance with the second output signal is output from the second speaker, the third output signal for the left side speaker and the fourth output signal for the right side speaker are generated by carrying out the transaural processing on the second acoustic signal, the transaural processing localizing, with respect to the second position located on the right of the listening position, the sound image from the sound from the third speaker and the fourth speaker in the third direction in front of or behind the second position and on the right of the second position, and the sound in accordance with the third output signal is output from the third speaker among the third output signal for the left side speaker and the fourth output signal for the right side speaker, and the sound in accordance with the fourth output signal is output from the fourth speaker.

According to the fourth aspect of the present technology, the first speaker is disposed in the first direction in front of or behind the predetermined listening position and on the left of the listening position, the second speaker is disposed in the first direction of the listening position and substantially in front of or substantially behind the listening position, the third speaker is disposed in the first direction and on the right of the listening position, in which the first output signal for the left side speaker and the second output signal for the right side speaker are generated by carrying out the transaural processing on the first acoustic signal, the transaural processing including localizing, with respect to the first position located on the left of the listening position, the sound image from the sound from the first speaker and the second speaker in the second direction in front of or behind the first position and on the left of the first position, and the sound in accordance with the first output signal is output from the first speaker among the first output signal for the left side speaker and the second output signal for the right side speaker, the third output signal for the left side speaker and the fourth output signal for the right side speaker are generated by carrying out the transaural processing on the second acoustic signal, the transaural processing localizing, with respect to the second position located on the right of the listening position, the sound image from the sound from the second speaker and the third speaker in the third direction in front of or behind the second position and on the right of the second position, and the sound in accordance with the fourth output signal is output from the third speaker among the third output signal for the left side speaker and the fourth output signal for the right side speaker, and the sound in accordance with the mixed signal of the second output signal and the third output signal are output from the second speaker.

Effects of the Invention

According to the first to fourth aspects of the present technology, the range of listening positions in which the listener can obtain the effect of the transaural reproduction system can be expanded.

It is noted that the effects listed here are not necessarily limited, and any one of the effects disclosed herein may be provided.

MODE FOR CARRYING OUT THE INVENTION

Modes for carrying out the present technology (hereinafter referred to as embodiments of the present technology) will be described below. It is noted that the description will be provided in the following order.

1. Characteristic of Transaural Reproduction System.
2. First Embodiment (example of executing normal transaural processing with four speakers).
3. Second Embodiment (example of executing transaural unification processing with four speakers).
4. Third Embodiment (example of executing normal transaural processing with three speakers).
5. Fourth Embodiment (first example of executing transaural unification processing with three speakers).
6. Fifth Embodiment (second example of executing transaural unification processing with three speakers).
7. Modification Example

1. Characteristic of Transaural Reproduction System

First, a characteristic of a transaural reproduction system will be described by referring to FIGS. 1 to 5.

As described above, a method of reproducing a binaural signal using left and right two-channel speakers is called a transaural reproduction system. However, if sound in accordance with the binaural signal is simply output from the speakers as it is, crosstalk, for example, is generated, such that sound for the right ear is audible to the left ear of a listener. Further, an acoustic transfer characteristic, for example, from the speaker to the right ear is superimposed while the sound for the right ear reaches the right ear of the listener, and hence the waveform of the sound is distorted.

Therefore, in the transaural reproduction system, pre-processing for canceling out the crosstalk and unnecessary acoustic transfer characteristic is carried out on the binaural signal. Hereinafter, this pre-processing is referred to as crosstalk compensation processing.

Meanwhile, the binaural signal can be generated even without recording sound by a microphone around an ear. Specifically, the binaural signal is a signal obtained by superimposing a head-related transfer function (HRTF) from a position of a sound source to a position around the ear on an acoustic signal. Therefore, if the HRTF is known, the binaural signal can be generated by carrying out signal processing of superimposing the HRTF on the acoustic signal. Hereinafter, this processing is referred to as binauralization processing.

The binauralization processing and the crosstalk compensation processing described above are carried out in a front surround system based on the HRTF. As used herein, the front surround system represents a virtual surround system that produces a quasi-surround sound field only with front speakers. Then, the binauralization processing and the crosstalk compensation processing are combined to implement transaural processing.

Figure 1:
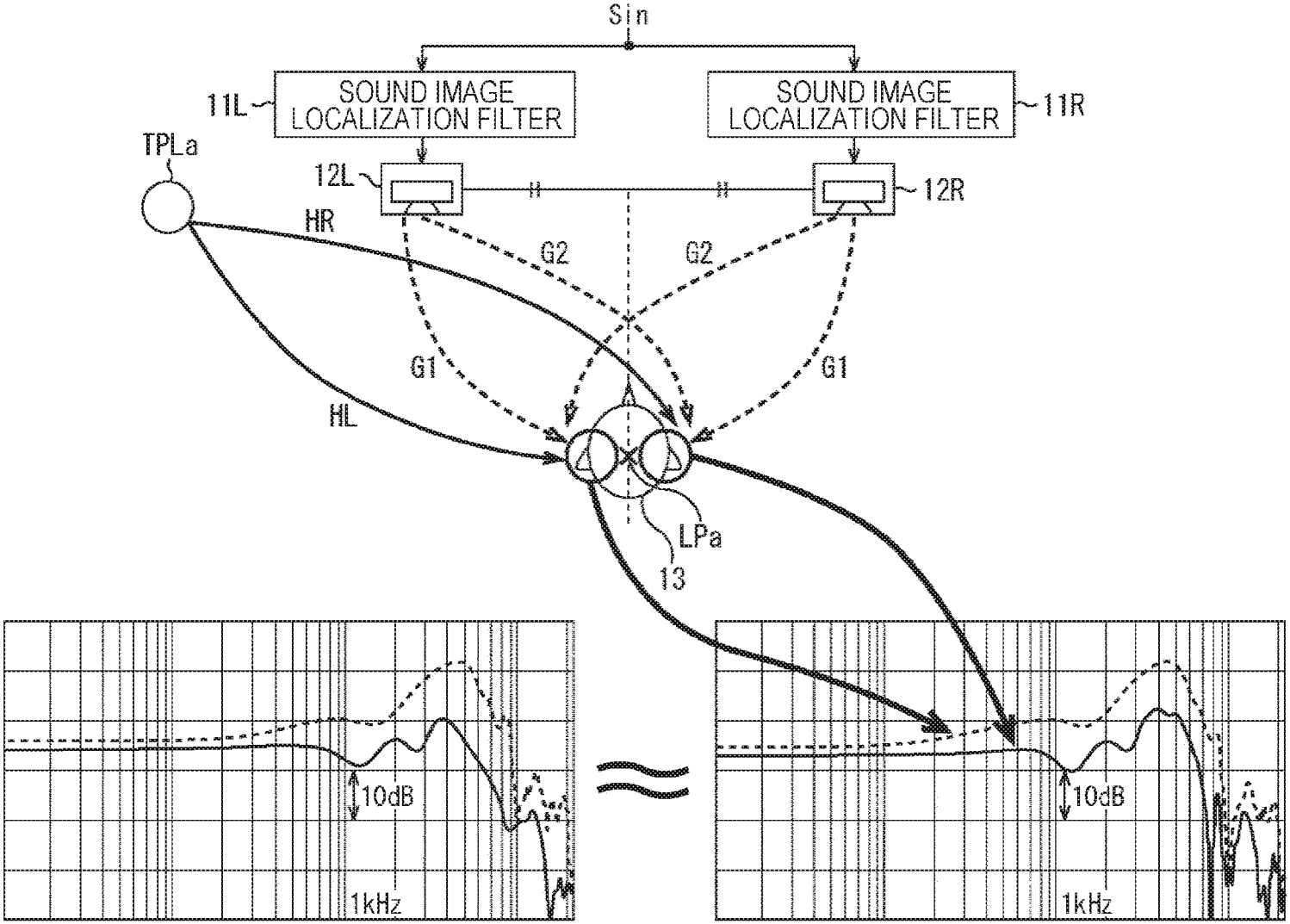
FIG. 1 is a diagram for explaining a characteristic of a transaural reproduction system.

FIG. 1 illustrates an example of a transaural reproduction system using sound image localizing filters 11L, 11R for localizing a sound image output from speakers 12L, 12R on the target position TPLa for a listener 13 who is located at a predetermined listening position LPa. In other words, this example illustrates generation of a virtual sound source (virtual speaker) at a target position TPLa for a listener 13 who is located at a listening position LPa. It is noted that a case where the target position TPLa is set at a position on the front left side of the listening position LPa and on the left of the speaker 12L is described below.

Moreover, hereinafter, the head-related acoustic transfer function HL between the target position TPLa and the left ear of the listener 13 on the side of the sound source is referred to as an HRTF on the side of the sound source, and the head-related acoustic transfer function HR between the target position TPLa and the right ear of the listener 13 on the side opposite to the sound source is referred to as an HRTF on the opposite side of the sound source. Further, hereinafter, in order to simplify explanations, an HRTF between the speaker 12L and the left ear of the listener 13 and an HRTF between the speaker 12R and the right ear of the listener 13 are assumed to be the same, and this HRTF is referred to as a head-related acoustic transfer function G1. Similarly, an HRTF between the speaker 12L and the right ear of the listener 13 and an HRTF between the speaker 12R and the left ear of the listener 13 are assumed to be the same, and this HRTF is referred to as a head-related acoustic transfer function G2.

As used herein, the side of the sound source indicates the side closer to the sound source (e.g., the target position TPLa) either in the right or left direction of the listening position LPa, and the opposite side of the sound source indicates the side far from the sound source. In other words, the side of the sound source is on the same side as the side of the space when divided left and right about the front center plane of the listener 13 who is located at the listening position LPa, and the opposite side of the sound source is on the side opposite to the sound source. Moreover, the HRTF on the side of the sound source indicates the HRTF corresponding to the ear of the listener on the side of the sound source, and the HRTF on the opposite side of the sound source is the HRTF corresponding to the ear of the listener on the opposite side of the sound source.

As illustrated in FIG. 1, the head-related acoustic transfer function G1 is superimposed before the sound from the speaker 12L reaches the left ear of the listener 13, and the head-related acoustic transfer function G2 is superimposed before the sound from the speaker 12R reaches the left ear of the listener 13. It is assumed herein that, with sound image localization filters 11L, 11R functioning in an ideal manner, the waveform of the sound generated by mixing sound from both speakers in the left ear of the listener 13 is identical to the waveform formed by canceling the influence of the head-related acoustic transfer functions G1, G2 and superimposing the head-related acoustic transfer function HL on the acoustic signal Sin.

Similarly, the head-related acoustic transfer function G1 is superimposed on the sound from the speaker 12R before the sound reaches the right ear of the listener 13, and the head-related acoustic transfer function G2 is superimposed on the sound from the speaker 12L before the sound reaches the right ear of the listener 13. It is assumed herein that, with sound image localization filters 11L, 11R functioning in an ideal manner, the waveform of the sound generated by mixing sound from both speakers in the left ear is identical to the waveform formed by canceling the influence of the head-related acoustic transfer functions G1, G2 and superimposing the head-related acoustic transfer function HR on the acoustic signal Sin.

A graph illustrated on the lower left of FIG. 1 represents a target HRTF, i.e., an ideal head-related acoustic transfer function (dotted line) HL and a head-related acoustic transfer function (solid line) HR. If the target HRTF is realized in both ears of the listener 13, the listener 13 can feel like the sound image of the sound from the speakers 12L, 12R is localized at the target position TPLa.

Meanwhile, a graph illustrated on the lower right of FIG. 1 represents a receiving characteristic of both ears of the listener 13, i.e., measurement values of the head-related acoustic transfer function HL at the left ear of the listener 13 (dotted line) and measurement values of the head-related acoustic transfer function HR at the right ear of the listener 13 (solid line). When the listener 13 is located at the listening position LPa, as illustrated in this drawing, the receiving characteristic of both ears of the listener 13 closely resembles the characteristic of the target HRTF over the entire band range. Therefore, the listener 13 can feel like the sound image is localized at the target position TPLa.

Figure 2:
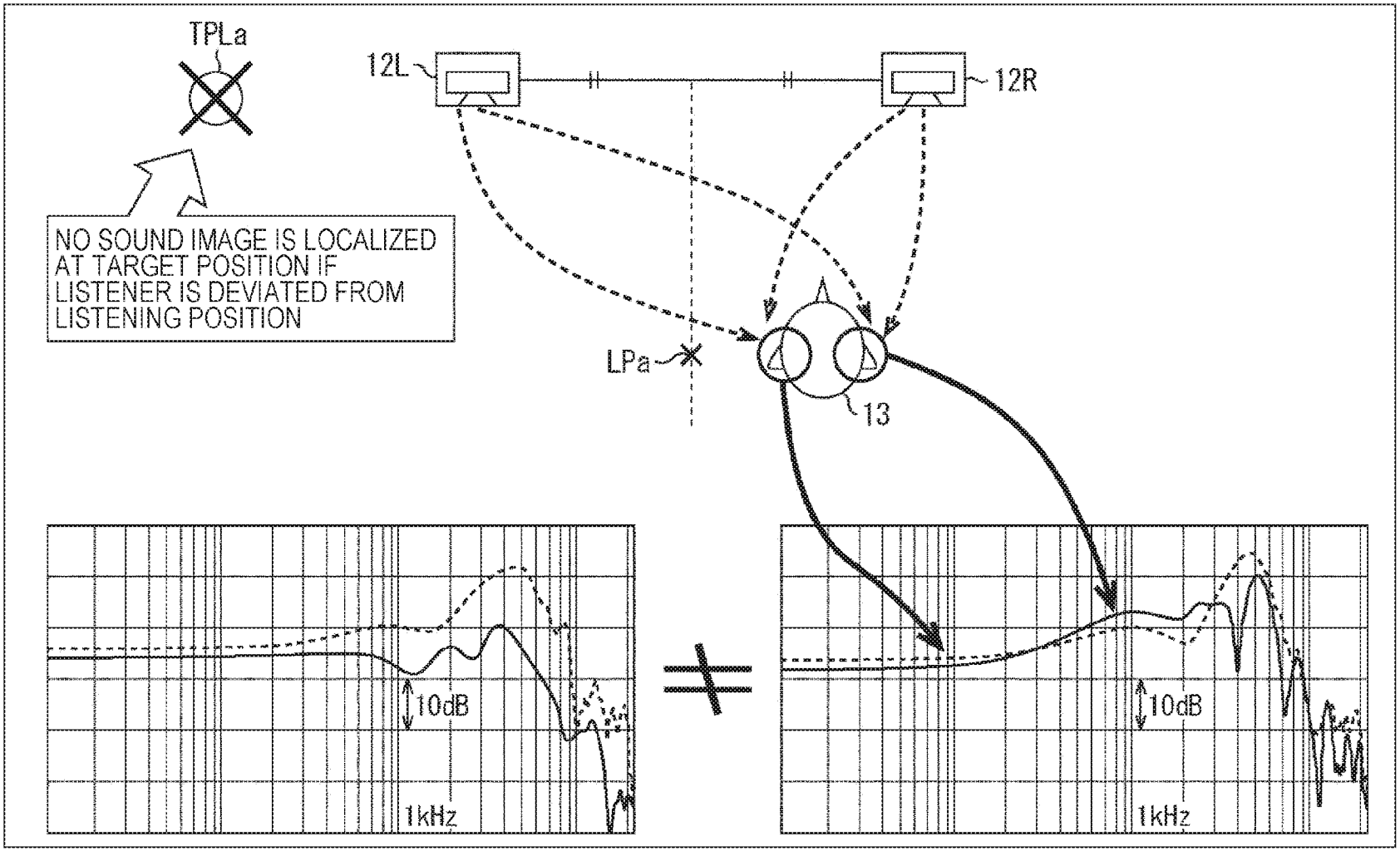
FIG. 2 is a diagram for explaining a characteristic of a transaural reproduction system.

Meanwhile, FIG. 2 illustrates a case where the listener 13 has moved to the right of the listening position LPa. A graph illustrated on the lower left of the drawing represents the target HRTF similarly to the graph illustrated in the lower left of FIG. 1. A graph illustrated on the lower right of the drawing represents a receiving characteristic of both ears of the listener 13 when the listener 13 is located at a position illustrated in FIG. 2.

As illustrated in the drawing, when the listener 13 is deviated to the right of the listening position LPa, the receiving characteristic of both ears of the listener 13 becomes widely different from the target HRTF. Accordingly, the sound image that the listener 13 feels is not localized at the target position TPLa. This is also true when the listener 13 is deviated to the left of the listening position LPa.

Thus, the sound image is not localized at the target position if the position of the listener is deviated from the ideal listening position in the transaural reproduction system. Namely, the listener can feel that the sound image is localized at the target position within a narrow area (hereinafter referred to as an effect area) in the transaural reproduction system. The effect area is particularly narrow in the lateral direction. Therefore, if the position of the listener is deviated laterally from the listening position, the localization of the sound image at the target position is canceled immediately.

Figure 3:
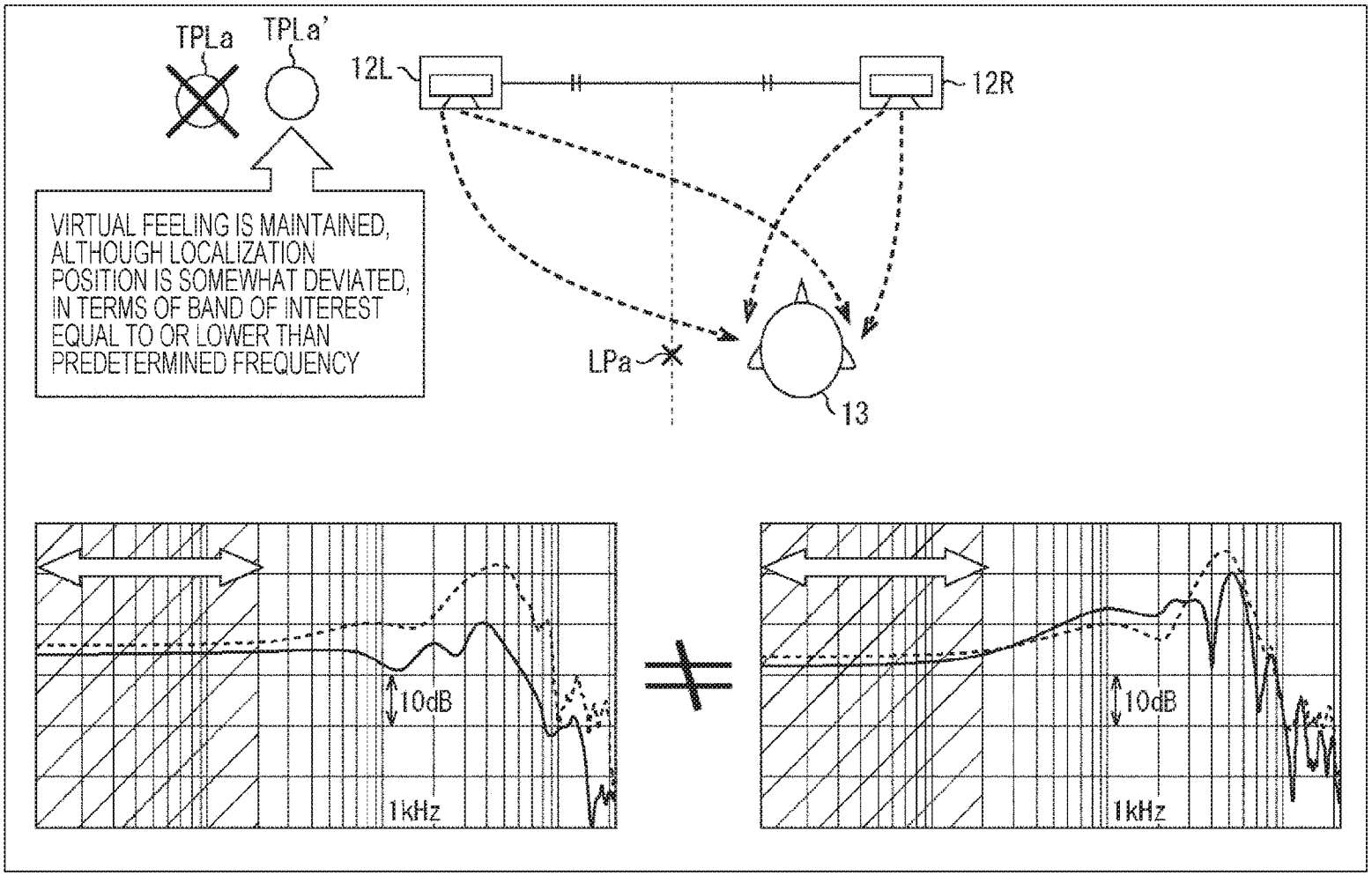
FIG. 3 is a diagram for explaining a characteristic of a transaural reproduction system.

Meanwhile, as illustrated in FIG. 3, when focusing only on the band equal to or lower than a predetermined frequency (hereinafter referred to as a band of interest), the receiving characteristic of both ears of the listener 13 is substantially similar to the target HRTF even when the listener 13 is deviated to the right of the listening position LPa. The listener 13, therefore, can feel that the sound image of the band of interest is localized at another target position TPLa' near the target position TPLa. Namely, with respect to the band of interest, the effect area expands larger than the effect area of the band of interest and the virtual feeling can be maintained, although the localization position is somewhat deviated. The effect area expands particularly in the lateral direction.

Figure 4:
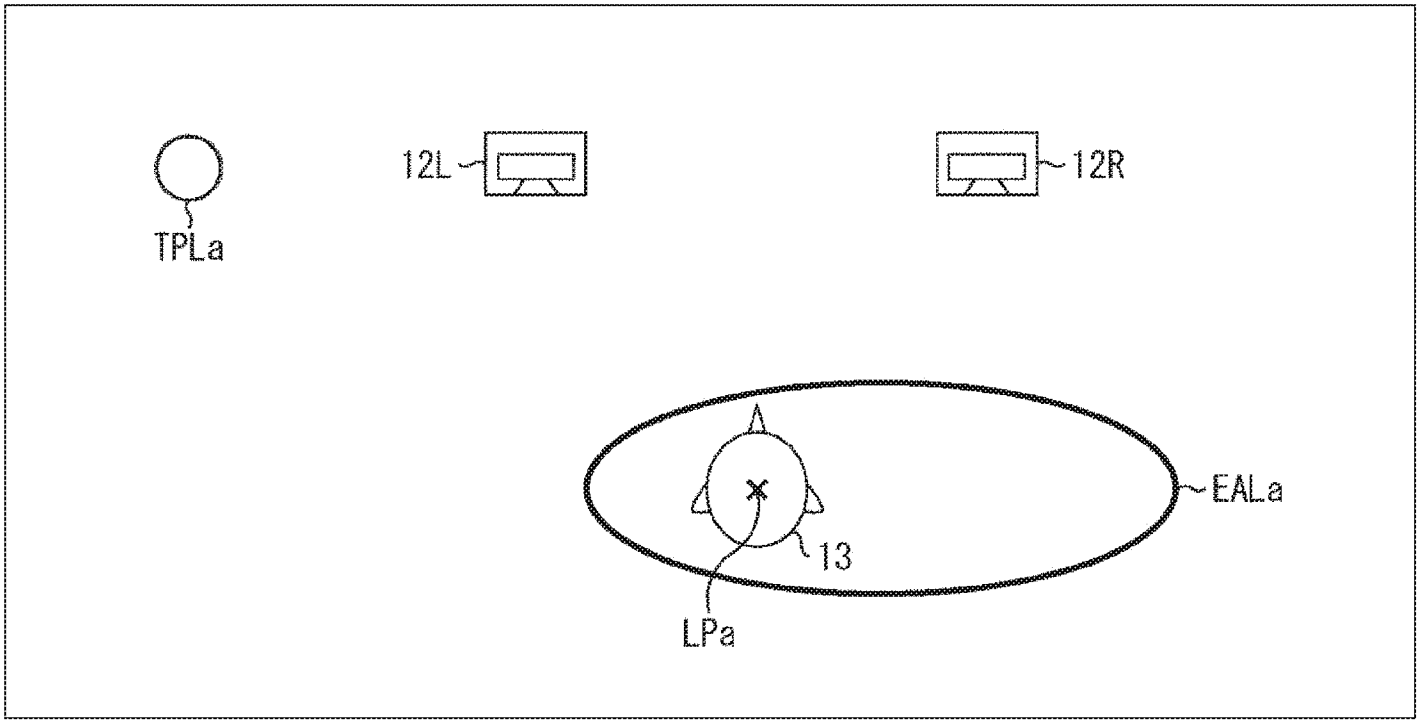
FIG. 4 illustrates an example of an effect area.

In practice, however, the listener rarely feels that the effect area is large for the band of interest. Specifically, as illustrated in FIG. 4, the effect area EALa of the band of interest relative to the target position TPLa does not expand bilaterally symmetrically relative to the listening position LPa. Namely, the effect area EALa is deviated to the side opposite to the target position TPLa about the listening position LPa, such that the effect area EALa is narrower on the side of the target position TPLa and wider on the side opposite to the target position TPLa. In other words, the effect area EALa is narrower on the left of the listening position LPa and wider on the right side.

Moreover, in the virtual surround system using the transaural reproduction system, it is less likely that the sound image is localized only on the left or right of the listening position. For example, as illustrated in FIG. 5, it is a usual practice to localize the sound image on, in addition to the target position TPLa, a target position TPRa located diagonally on the front right of the listening position LPa and on the right of the speaker 12R.

In this case, an effect area EARa of the band of interest relative to the target position TPRa is deviated to the side opposite to the target position TPRa about the listening position LPa, such that the effect area EARa is narrower on the side of the target position TPRa and wider on the side opposite to the target position TPRa. Namely, on the contrary to the effect area EALa, the effect area EARa is wider on the left of the listening position LPa and narrower on the right of the listening position LPa.

Then, when the listener 13 is located in an area (hereinafter referred to as a service area) SAa in which the effect areas EALa and EARa overlap each other, the listener 13 feels that the sound image of the band of interest is localized at the target positions TPLa and TPRa. Meanwhile, when the listener 13 moves out of the service area SAa, the listener 13 feels that the sound image of the band of interest is not localized at least on the target position TPLa or TPRa. Namely, the listener 13 has a deteriorated localization feeling regarding the band of interest.

Figure 5:
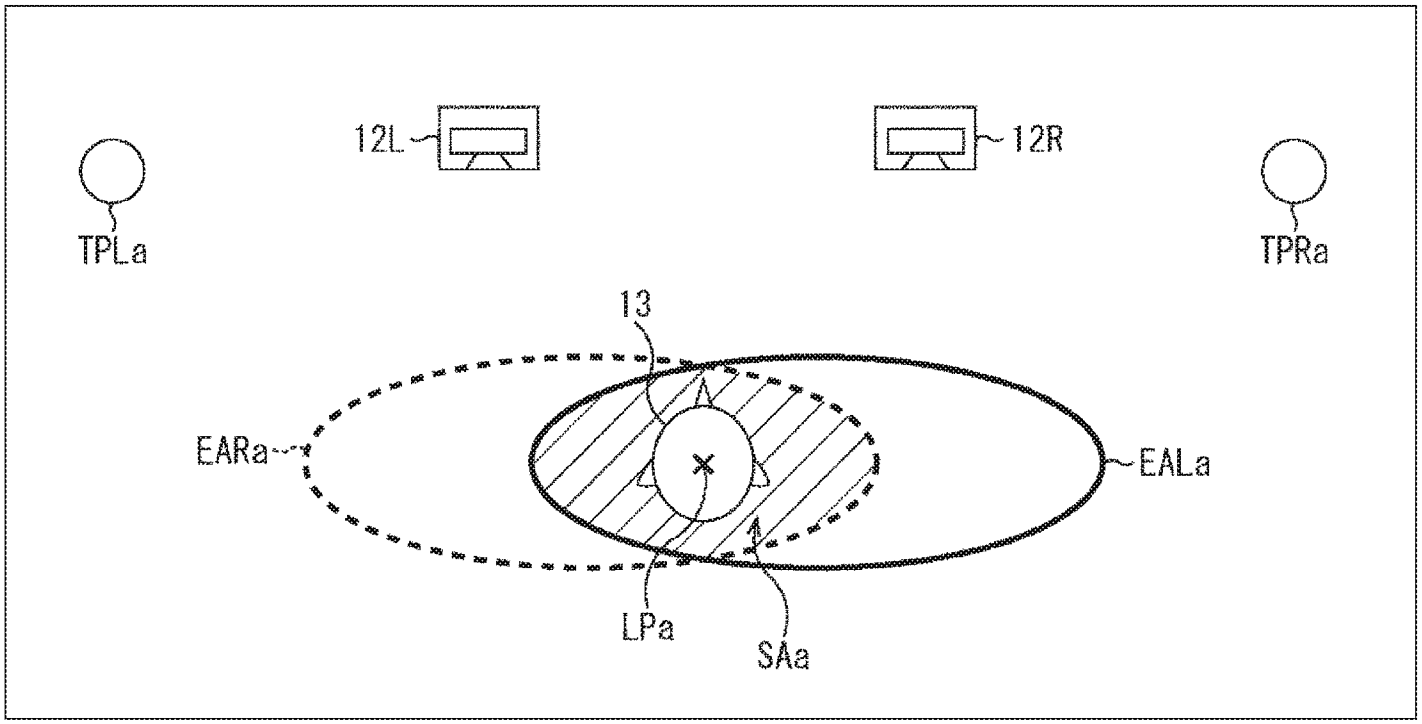
FIG. 5 illustrates an example of a service area.

Moreover, as illustrated in FIG. 5, the effect areas EALa and EARa are both deviated laterally in opposite directions to the right or left about the listening position LPa. Therefore, the service area SAa where the effect areas EALa and EARa overlap each other is laterally very narrow. As a result of this, the listener 13 would be out of the service area SAa when the listener 13 laterally moves only slightly from the listening position LPa, thus deteriorating the localization feeling of the listener 13 for the band of interest.

In view of the above, the present technology expands the service area for the band of interest particularly laterally as described below.

2. First Embodiment

Next, a first embodiment of the acoustic signal processing system to which the present technology is applied is described by referring to FIGS. 6 to 10.

{Configuration Example of Acoustic Signal Processing System 101}

Figure 6:
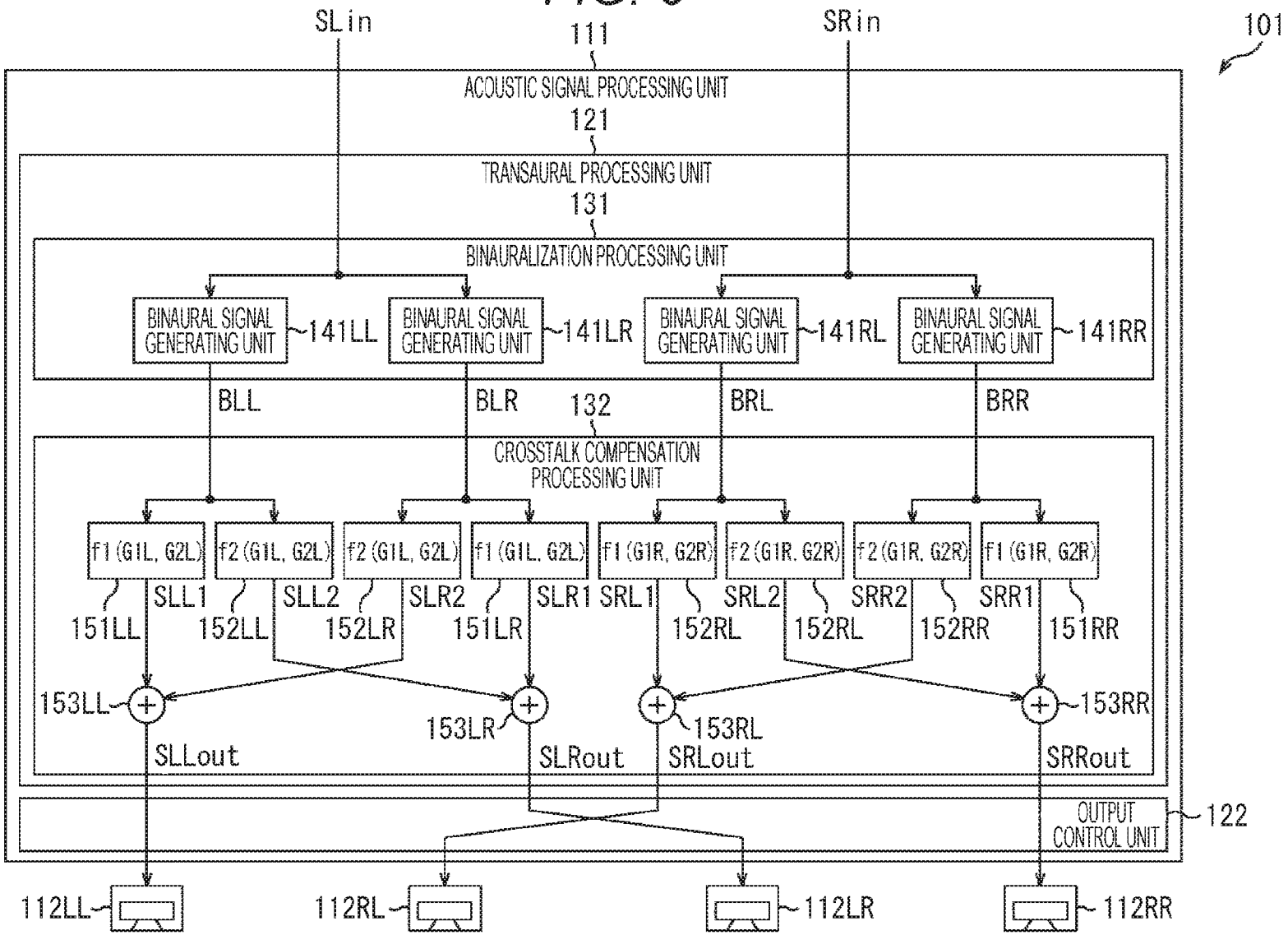
FIG. 6 is a block diagram illustrating a first embodiment of an acoustic signal processing system to which the present technology is applied.

FIG. 6 illustrates a functional configuration example of an acoustic signal processing system 101 as a first embodiment of the present technology.

The acoustic signal processing system 101 is configured to include an acoustic signal processing unit 111 and speakers 112LL to 112RR.

Figure 7:
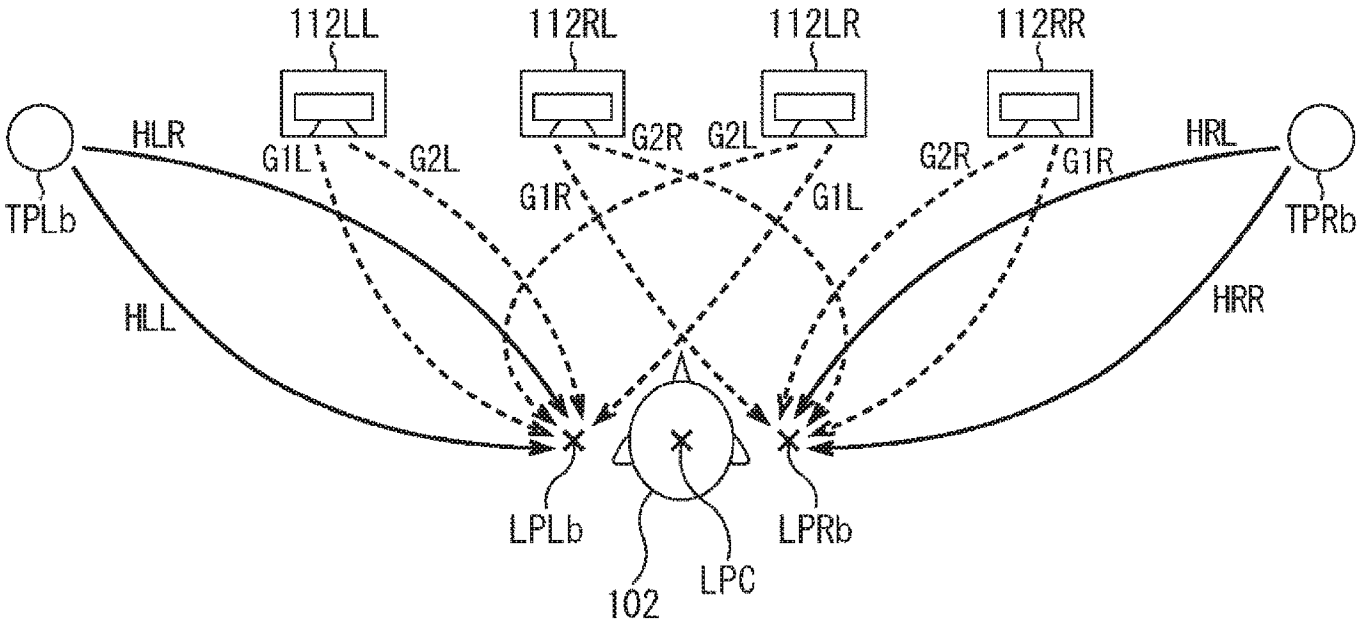
FIG. 7 illustrates an arrangement example of speakers.

FIG. 7 is an arrangement example of the speakers 112LL to 112RR.

The speakers 112LL to 112RR are arranged substantially linearly and laterally in front of a listening position LPC in the order of the speaker 112LL, the speaker 112RL, the speaker 112LR, and the speaker 112RR from the left. The speakers 112LL, 112RL are disposed on the left of the listening position LPC, and the speakers 112LR, 112RR are disposed on the right of the listening position LPC. Moreover, a distance between the speakers 112LL and 112LR is set substantially equal to a distance between the speakers 112RL and 112RR.

The acoustic signal processing system 101 carries out localization processing of the sound image from the speakers 112LL, 112LR at a target position TPLb relative to a virtual listening position LPLb located on the left of the listening position LPC. The virtual listening position LPLb is located substantially in the center between the speakers 112LL and 112LR in the lateral direction. The target position TPLb is located on the front left of the virtual listening position LPLb and on the left of the speaker 112LL.

Moreover, the acoustic signal processing system 101 carries out localization processing of the sound image from the sound from the speakers 112RL, 112RR at a target position TPRb with respect to a virtual listening position LPRb located on the right of the listening position LPC. The virtual listening position LPRb is located substantially in the center between the speakers 112RL and 112RR in the lateral direction. The target position TPRb is located on the front right of the virtual listening position LPRb and on the right of the speaker 112RR.

It is noted, hereinafter, that, when the listener 102 is located at the virtual listening position LPLb, the HRTF on the side of the sound source between the target position TPLb and the left ear of the listener 102 is referred to as a head-related acoustic transfer function HLL, and the HRTF on the side of the sound source between the target position TPLb and the right ear of the listener 102 is referred to as a head-related acoustic transfer function HLR. It is also assumed in the following that, when the listener 102 is located at the virtual listening position LPLb, the HRTF between the speaker 112LL and the left ear of the listener 102 is the same as the HRTF between the speaker 112LR and the right ear of the listener 102, and such HRTF is referred to as a head-related acoustic transfer function G1L. Further, it is assumed in the following that, when the listener 102 is located at the virtual listening position LPLb, the HRTF between the speaker 112LL and the right ear of the listener 102 is the same as the HRTF between the speaker 112LR and the left ear of the listener 102, and such HRTF is referred to as a head-related acoustic transfer function G2L.

It is also assumed in the following that, when the listener 102 is located at the virtual listening position LPRb, the HRTF on the side of the sound source between the target position TPRb and the left ear of the listener 102 is referred to as a head-related acoustic transfer function HRL, and the HRTF on the side of the sound source between the target position TPRb and the right ear of the listener 102 is referred to as a head-related acoustic transfer function HRR. It is also assumed in the following that, when the listener 102 is located at the virtual listening position LPRb, the HRTF between the speaker 112RL and the left ear of the listener 102 is the same as the HRTF between the speaker 112RR and the right ear of the listener 102, and such HRTF is referred to as a head-related acoustic transfer function G1R. Further, it is assumed in the following that, when the listener 102 is located at the virtual listening position LPRb, the HRTF between the speaker 112RL and the right ear of the listener 102 is the same as the HRTF between the speaker 112RR and the left ear of the listener 102, and such HRTF is referred to as a head-related acoustic transfer function G2R.

The acoustic signal processing unit 111 is configured to include a transaural processing unit 121 and an output control unit 122. The transaural processing unit 121 is configured to include a binauralization processing unit 131 and a crosstalk compensation processing unit 132. The binauralization processing unit 131 is configured to include binaural signal generating units 141LL to 141RR. The crosstalk compensation processing unit 132 is configured to include signal processing units 151LL to 151RR and 152LL to 152RR, and addition units 153LL to 153RR.

The binaural signal generating unit 141LL generates a binaural signal BLL by superimposing the head-related acoustic transfer function HLL on the acoustic signal SLin input from the outside. The binaural signal generating unit 141LL supplies the generated binaural signal BLL to the signal processing units 151LL, 152LL.

The binaural signal generating unit 141LR generates a binaural signal BLR by superimposing the head-related acoustic transfer function HLR on the acoustic signal SLin input from the outside. The binaural signal generating unit 141LR supplies the generated binaural signal BLR to the signal processing units 151LR, 152LR.

The binaural signal generating unit 141RL generates a binaural signal BRL by superimposing the head-related acoustic transfer function HRL on the acoustic signal SRin input from the outside. The binaural signal generating unit 141RL supplies the generated binaural signal BRL to the signal processing units 151RL, 152RL.

The binaural signal generating unit 141RR generates a binaural signal BRR by superimposing the head-related acoustic transfer function HRR on the acoustic signal SRin input from the outside. The binaural signal generating unit 141RR supplies the generated binaural signal BRR to the signal processing units 151RR, 152RR.

The signal processing unit 151LL generates an acoustic signal SLL1 by superimposing a predetermined function f1(G1L, G2L), where the head-related acoustic transfer functions G1L and G2L are used as variables, on the binaural signal BLL. The signal processing unit 151LL supplies the generated acoustic signal SLL1 to the addition unit 153LL.

Similarly, the signal processing unit 151LR generates an acoustic signal SLR1 by superimposing the function f1(G1L, G2L) on the binaural signal BLR. The signal processing unit 151LR supplies the generated acoustic signal SLR1 to the addition unit 153LR.

It is noted that the function f1(G1L, G2L) is expressed, for example, as Equation (1) below.

$$f1(G1L,G2L)=1/(G1L+G2L)+1/(G1L-G2L) \quad (1)$$

The signal processing unit 152LL generates an acoustic signal SLL2 by superimposing a predetermined function f2(G1L, G2L), where the head-related acoustic transfer functions G1L and G2L are used as variables, on the binaural signal BLL. The signal processing unit 152LL supplies the generated acoustic signal SLL2 to the addition unit 153LR.

Similarly, the signal processing unit 152LR generates an acoustic signal SLR2 by superimposing the function f2(G1L, G2L) on the binaural signal BLR. The signal processing unit 152LR supplies the generated acoustic signal SLR2 to the addition unit 153LL.

It is noted that the function f2(G1L, G2L) is expressed, for example, as Equation (2) below.

$$f2(G1L,G2L)=1/(G1L+G2L)-1/(G1L-G2L) \quad (2)$$

The signal processing unit 151RL generates an acoustic signal SRL1 by superimposing a predetermined function f1(G1R, G2R), where the head-related acoustic transfer functions G1R and G2R are used as variables, on the binaural signal BRL. The signal processing unit 151RL supplies the generated acoustic signal SRL1 to the addition unit 153RL.

Similarly, the signal processing unit 151RR generates an acoustic signal SRR1 by superimposing the function f1(G1R, G2R) on the binaural signal BRR. The signal processing unit 151RR supplies the generated acoustic signal SRR1 to the addition unit 153RR.

It is noted that the function f1(G1R, G2R) is expressed, for example, as Equation (3) below.

$$f1(G1R,G2R)=1/(G1R+G2R)+1/(G1R-G2R) \quad (3)$$

The signal processing unit 152RL generates an acoustic signal SRL2 by superimposing a predetermined function f2(G1R, G2R), where the head-related acoustic transfer functions G1R and G2R are used as variables, on the binaural signal BRL. The signal processing unit 152RL supplies the generated acoustic signal SRL2 to the addition unit 153RR.

Similarly, the signal processing unit 152RR generates an acoustic signal SRR2 by superimposing the function f2(G1R, G2R) on the binaural signal BRR. The signal processing unit 152RR supplies the generated acoustic signal SRR2 to the addition unit 153RL.

It is noted that the function f2(G1R, G2R) is expressed, for example, as Equation (4) below.

$$f2(G1R,G2R)=1/(G1R+G2R)-1/(G1R-G2R) \quad (4)$$

The addition unit 153LL adds acoustic signals SLL1 and SLR2 to generate an output signal SLLout, which is an acoustic signal for output, to the output control unit 122. The output control unit 122 outputs the output signal SLLout to the speaker 112LL. The speaker 112LL outputs sound in accordance with the output signal SLLout.

The addition unit 153LR adds acoustic signals SLR1 and SLL2 to generate an output signal SLRout, which is an acoustic signal for output, to the output control unit 122. The output control unit 122 outputs the output signal SLRout to the speaker 112LR. The speaker 112LR outputs sound in accordance with the output signal SLRout.

The addition unit 153RL adds acoustic signals SRL1 and SRR2 to generate an output signal SRLout, which is an acoustic signal for output, to the output control unit 122. The output control unit 122 outputs the output signal SRLout to the speaker 112RL. The speaker 112RL outputs sound in accordance with the output signal SRLout.

The addition unit 153RR adds acoustic signals SRR1 and SRL2 to generate an output signal SRRout, which is an acoustic signal for output, to the output control unit 122. The output control unit 122 outputs the output signal SRRout to the speaker 112RR. The speaker 112RR outputs sound in accordance with the output signal SRRout.

{Acoustic Signal Processing by Acoustic Signal Processing System 101}

Figure 8:
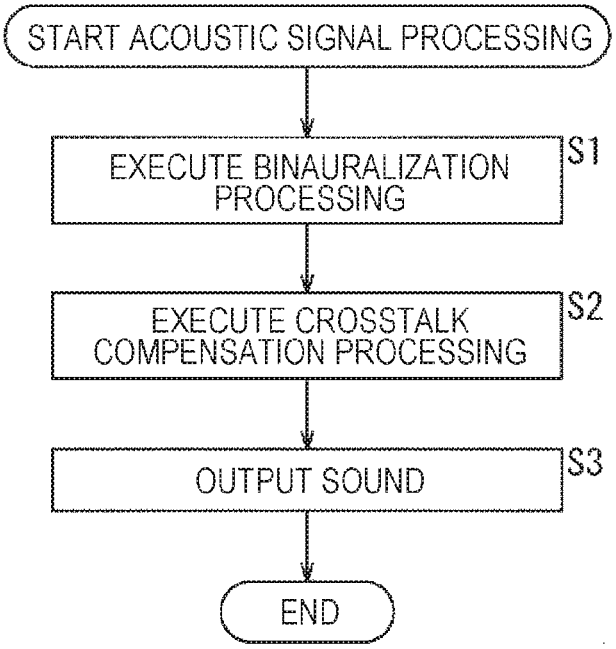
FIG. 8 is a flowchart for explaining acoustic signal processing.

Next, the acoustic signal processing executed by the acoustic signal processing system 101 is described by referring to a flowchart of FIG. 8.

In step S1, the binaural signal generating units 141LL to 141RR carry out binauralization processing. Specifically, the binaural signal generating unit 141LL generates the binaural signal BLL by superimposing the head-related acoustic transfer function HLL on the acoustic signal SLin input from the outside. The binaural signal generating unit 141LL supplies the generated binaural signal BLL to the signal processing units 151LL, 152LL.

The binaural signal generating unit 141LR generates a binaural signal BLR by superimposing the head-related acoustic transfer function HLR on the acoustic signal SLin input from the outside. The binaural signal generating unit 141LR supplies the generated binaural signal BLR to the signal processing units 151LR, 152LR.

The binaural signal generating unit 141RL generates a binaural signal BRL by superimposing the head-related acoustic transfer function HRL on the acoustic signal SRin input from the outside. The binaural signal generating unit 141RL supplies the generated binaural signal BRL to the signal processing units 151RL, 152RL.

The binaural signal generating unit 141RR generates a binaural signal BRR by superimposing the head-related acoustic transfer function HRR on the acoustic signal SRin input from the outside. The binaural signal generating unit 141RR supplies the generated binaural signal BRR to the signal processing units 151RR, 152RR.

In step S2, the crosstalk compensation processing unit 132 carries out crosstalk compensation processing. Specifically, the signal processing unit 151LL generates the acoustic signal SLL1 by superimposing the function f1(G1L, G2L) mentioned above on the binaural signal BLL. The signal processing unit 151LL supplies the generated acoustic signal SLL1 to the addition unit 153LL.

The signal processing unit 151LR generate the acoustic signal SLR1 by superimposing the function f1(G1L, G2L) on the binaural signal BLR. The signal processing unit 151LR supplies the generated acoustic signal SLR1 to the addition unit 153LR.

The signal processing unit 152LL generates the acoustic signal SLL2 by superimposing the function f2(G1L, G2L) mentioned above on the binaural signal BLL. The signal processing unit 152LL supplies the generated acoustic signal SLL2 to the addition unit 153LR.

The signal processing unit 151LR generates the acoustic signal SLR2 by superimposing the function f2(G1L, G2L) on the binaural signal BLR. The signal processing unit 151LR supplies the generated acoustic signal SLR2 to the addition unit 153LL.

The signal processing unit 151RL generates the acoustic signal SRL1 by superimposing the function f1(G1R, G2R) mentioned above on the binaural signal BRL. The signal processing unit 151RL supplies the generated acoustic signal SRL1 to the addition unit 153RL.

The signal processing unit 151RR generates the acoustic signal SRR1 by superimposing the function f1(G1R, G2R) on the binaural signal BRR. The signal processing unit 151RR supplies the generated acoustic signal SRR1 to the addition unit 153RR.

The signal processing unit 152RL generates the acoustic signal SRL2 by superimposing the function f2(G1R, G2R) mentioned above on the binaural signal BRL. The signal processing unit 152RL supplies the generated acoustic signal SRL2 to the addition unit 153RR.

The signal processing unit 152RR generates the acoustic signal SRR2 by superimposing the function f2(G1R, G2R) on the binaural signal BRR. The signal processing unit 152RR supplies the generated acoustic signal SRR2 to the addition unit 153RL.

The addition unit 153LL adds the acoustic signals SLL1 and SLR2 to generate the output signal SLLout which is supplied to the output control unit 122.

The addition unit 153LR adds the acoustic signals SLR1 and SLL2 to generate the output signal SLRout which is supplied to the output control unit 122.

The addition unit 153RL adds the acoustic signals SRL1 and SRR2 to generate the output signal SRLout which is supplied to the output control unit 122.

The addition unit 153RR adds the acoustic signals SRR1 and SRL2 to generate the output signal SRRout which is supplied to the output control unit 122.

In step S3, the acoustic signal processing system 101 outputs sound. Specifically, the output control unit 122 supplies the output signal SLLout to the speaker 112LL, and the speaker 112LL outputs sound in accordance with the output signal SLLout. The output control unit 122 supplies the output signal SLRout to the speaker 112LR, and the speaker 112LR outputs sound in accordance with the output signal SLRout. The output control unit 122 supplies the output signal SRLout to the speaker 112RL, and the speaker 112RL outputs sound in accordance with the output signal SRLout. The output control unit 122 supplies the output signal SRRout to the speaker 112RR, and the speaker 112RR outputs sound in accordance with the output signal SRRout.

Figure 9:
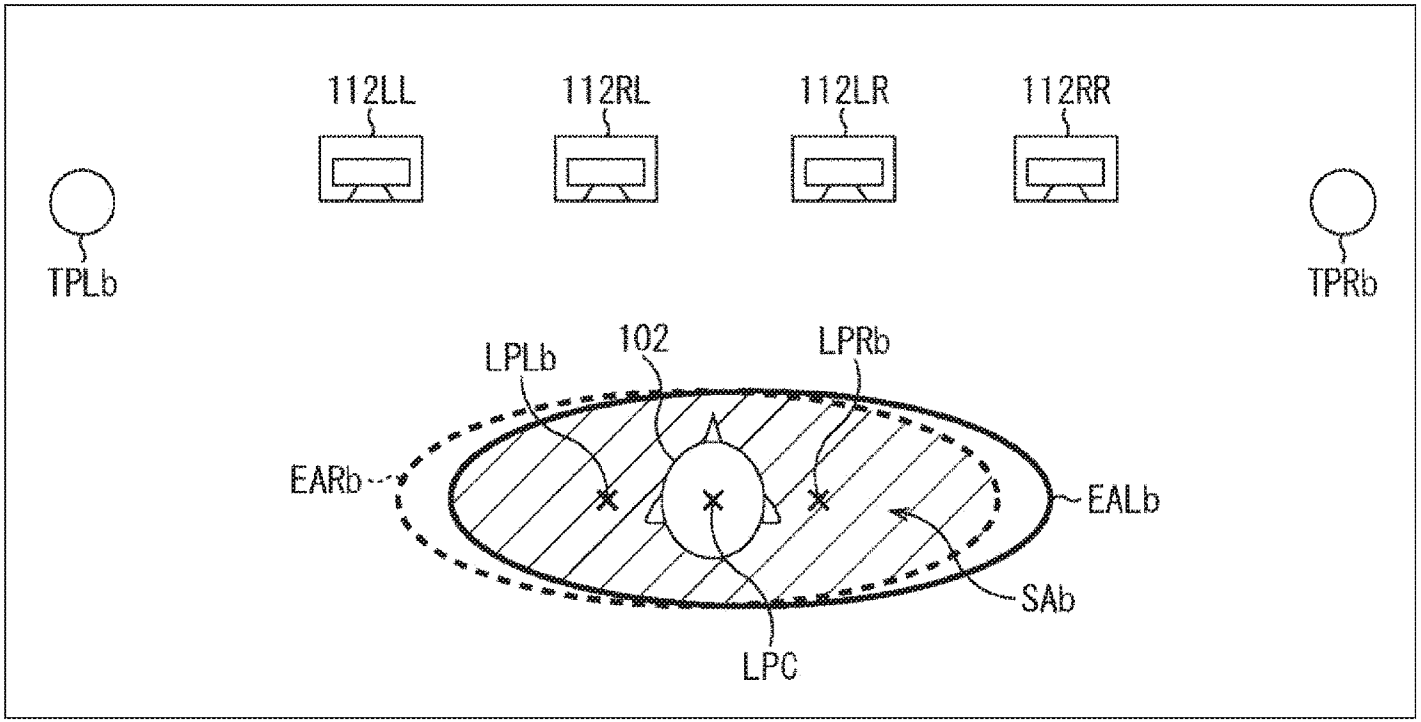
FIG. 9 illustrates an example of a service area.

Thus, as illustrated in FIG. 9, the sound image of the sound from the speakers 112LL, 112LR is localized at the target position TPLb with respect to the virtual listening position LPLb located on the left of the listening position LPC. The sound image of the sound from the speakers 112RL, 112RR is localized at the target position TPRb with respect to the virtual listening position LPRb located on the right of the listening position LPC.

Here, an effect area EALb of the target position TPLb is deflected to the side opposite to the target position TPLb with respect to the virtual listening position LPLb, such that the effect area EALb is narrower on the side of the target position TPLb and wider on the side opposite to the target position TPLb. Namely, the effect area EALb is narrower on the left of the virtual listening position LPLb and wider on the right of the virtual listening position LPLb. Meanwhile, the listening position LPC is located on the right of the virtual listening position LPLb, allowing the lateral deflection of the effect area EALb to be smaller at the listening position LPC than at the virtual listening position LPLb.

Meanwhile, an effect area EARb of the target position TPRb is deflected to the side opposite to the target position TPRb with respect to the virtual listening position LPRb, such that the effect area EARb is narrower on the side of the target position TPRb and wider on the side opposite to the target position TPRb. Namely, the effect area EARb is narrower on the right of the virtual listening position LPRb and wider on the left of the virtual listening position LPRb. Meanwhile, the listening position LPC is located on the left of the virtual listening position LPRb, allowing the lateral deflection of the effect area EARb to be smaller at the listening position LPC than at the virtual listening position LPRb.

Thus, the effect areas EALb and EARb overlap each other to generate an overlapped area which turns a service area SAb. The service area SAb is laterally wider and has a larger area than the service area SAa of FIG. 5. Therefore, if the listener 102 moves laterally to some extent from the listening position LPC, the listener 102 can remain in the service area SAb and the listener 13 feels that the sound image of the band of interest is located near the target positions TPLb and TPRb. As a result of this, the listener 13 improves localization feeling of the listener 13 for the band of interest.

It is noted that the effect area EALb is larger as the distance between the speaker 112LL and the target position TPLb is closer. Similarly, the effect area EARb is larger as the distance between the speaker 112RR and the target position TPRb is closer. Furthermore, when at least one of the effect areas EALb and EARb expands, the service area SAb also expands.

{Configuration Example of External Appearance of Acoustic Signal Processing System 101}

Figure 10:
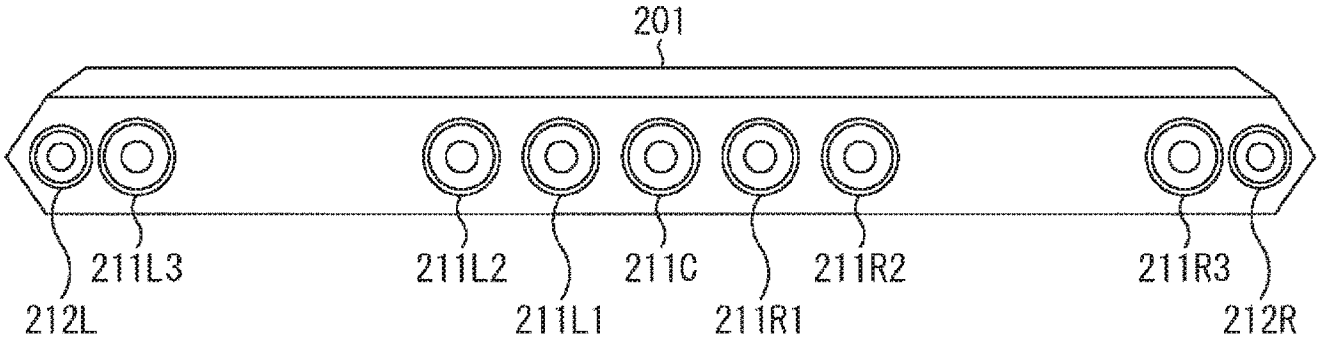
FIG. 10 is a front view illustrating a configuration example of external appearance of a first embodiment of the acoustic signal processing system.

FIG. 10 is a front view illustrating a configuration example of external appearance of the acoustic signal processing system 101. The acoustic signal processing system 101 includes a casing 201, a speaker 211C, speakers 211L1 to 211L3, speakers 211R1 to 211R3, a tweeter 212L, and a tweeter 212R.

The casing 201 is thin-box shaped with right and left ends protruding in a triangular manner. For example, the acoustic signal processing unit 111, which is not illustrated, is disposed in the casing 201.

On the front side of the casing 201, the speaker 211C, the speakers 211L1 to 211L3, the speakers 211R1 to 211R3, the tweeter 212L, and the tweeter 212R are arranged linearly in the lateral direction. It is noted that the tweeter 212L and the speaker 211L3 form a speaker unit, and the tweeter 212R and the speaker 211R3 form another speaker unit.

The speaker 211C is arranged in the center of the front side of the casing 201. The speakers 211L1 to 211L3 and the tweeter 212L are arranged laterally symmetrically with the speakers 211R1 to 211R3 and the tweeter 212R about the speaker 211C. The speaker 211L1 is disposed next to the speaker 211C on the left, and the speaker 211R1 is disposed next to the speaker 211C on the right. The speaker 211L2 is disposed net to the speaker 211L1 on the left, and the speaker 211R2 is disposed next to the speaker 211R1 on the right. The tweeter 212L is disposed near the left end of the front side of the casing 201, and the speaker 211L3 is disposed on the right of the tweeter 212L. The tweeter 212R is disposed near the right end of the front side of the casing 201, and the speaker 211R3 is disposed on the left of the tweeter 212R.

The speaker 112LL of FIG. 6 is formed of the speaker 211L2 or the speaker unit including the tweeter 212L and the speaker 211L3. In a case where the speaker 112LL is formed of the speaker 211L2, the speaker 112RL of FIG. 6 is formed of the speaker 211L1. In the case where the speaker 112LL is formed of the speaker unit including the tweeter 212L and the speaker 211L3, the speaker 112RL is formed of the speaker 211L1 or 211L2.

The speaker 112RR of FIG. 6 is formed of the speaker 211R2 or the speaker unit including the tweeter 212R and the speaker 211R3. In a case where the speaker 112RR is formed of the speaker 211R2, the speaker 112LR of FIG. 6 is formed of the speaker 211R1. In a case where the speaker 112RR is formed of the speaker unit including the tweeter 212R and the speaker 211R3, the speaker 112LR is formed of the speaker 211R1 or the speaker 211R2.

It is noted that the acoustic signal processing unit 111 and the speakers 112LL to 112RR are formed unitarily in the example of FIG. 10, but the acoustic signal processing unit 111 and the speakers 112LL to 112RR may be provided separately. Alternatively, the speakers 112LL to 112RR may be separately provided, so that the position of each speaker can individually be adjusted.

3. Second Embodiment

Figure 11:
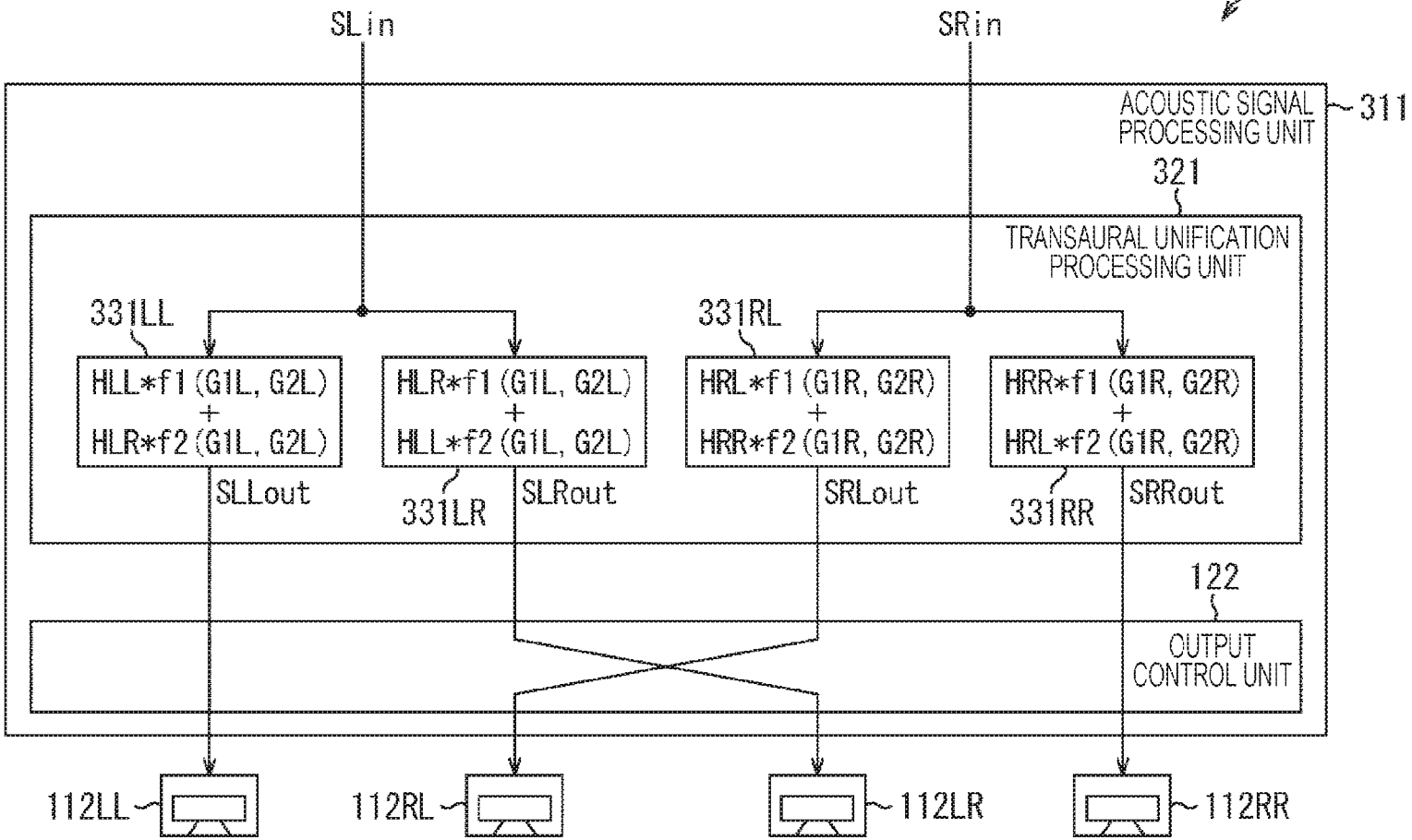
FIG. 11 is a block diagram illustrating a second embodiment of the acoustic signal processing system to which the present technology is applied.

Next, a second embodiment of the acoustic signal processing system to which the present technology is applied is described by referring to FIG. 11.

FIG. 11 illustrates a functional configuration example of an acoustic signal processing system 301 as a second embodiment of the present technology. It is noted that the same reference signs are given to the constituent parts corresponding to those of FIG. 6, and the description of such constituent parts to which the processing similar to the processing of FIG. 6 is carried out is not repeated and appropriately skipped.

The acoustic signal processing system 301 differs from the acoustic signal processing system 101 of FIG. 6 in that an acoustic signal processing unit 311 is provided in place of the acoustic signal processing unit 111. The acoustic signal processing unit 311 differs from the acoustic signal processing unit 111 in that a transaural unification processing unit 321 which is another mode of the transaural processing unit is provided in place of the transaural processing unit 121. The transaural unification processing unit 321 is configured to include signal processing units 331LL to 331RR. The signal processing units 331LL to 331RR are implemented, for example, by finite impulse response (FIR) filters.

The transaural unification processing unit 321 carries out unification processing including binauralization processing and crosstalk compensation processing on the acoustic signals SLin and SRin. For example, the signal processing unit 331LL carries out processing as represented by Equation (5) below on the acoustic signal SLin to generate an output signal SLLout.

$$SLLout=\{HLL*f1(G1L,G2L)+HLR*f2(G1L,G2L)\}\times SLin \quad (5)$$

The output signal SLLout is identical to the output signal SLLout of the acoustic signal processing system 101. The signal processing unit 331LL supplies the output signal SLLout to the output control unit 122.

The signal processing unit 331LR carries out processing represented by Equation (6) below to the acoustic signal SLin to generate an output signal SLRout.

$$SLRout=\{HLR*f1(G1L,G2L)+HLL*f2(G1L,G2L)\}\times SLin \quad (6)$$

The output signal SLRout is identical to the output signal SLRout of the acoustic signal processing system 101. The signal processing unit 331LR supplies the output signal SLRout to the output control unit 122.

The signal processing unit 331RL carries out processing represented by Equation (7) below on the acoustic signal SRin to generate an output signal SRLout.

$$SRLout=\{HRL*f1(G1R,G2R)+HRR*f2(G1R,G2R)\}\times SRin \quad (7)$$

The output signal SRLout is identical to the output signal SRLout of the acoustic signal processing system 101. The signal processing unit 331RL supplies the output signal SRLout to the output control unit 122.

The signal processing unit 331RR carries out processing represented by Equation (8) below to generate an output signal SRRout.

$$SRRout=\{HRR*f1(G1R,G2R)+HRL*f2(G1R,G2R)\}\times SRin \quad (8)$$

The output signal SRRout is identical to the output signal SRRout of the acoustic signal processing system 101. The signal processing unit 331RR supplies the output signal SRRout to the output control unit 122.

This allows the acoustic signal processing system 301 to expand the service area for the band of interest in a similar manner to the acoustic signal processing system 101. Moreover, it is expected that the acoustic signal processing system 301 can generally decrease the load of signal processing compared to the acoustic signal processing system 101.

4. Third Embodiment

Figure 12:
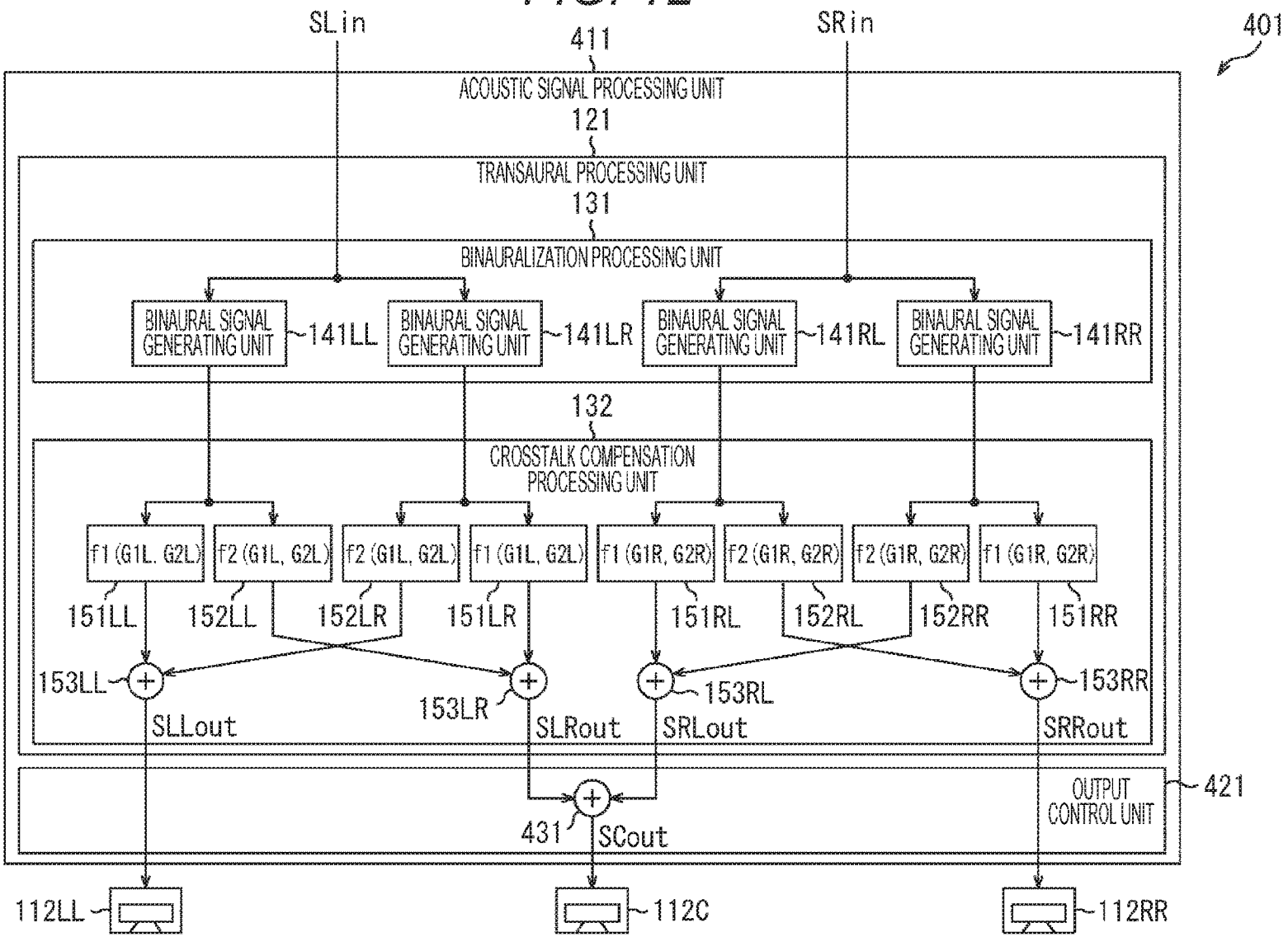
FIG. 12 is a block diagram illustrating a third embodiment of the acoustic signal processing system to which the present technology is applied.
Figure 13:
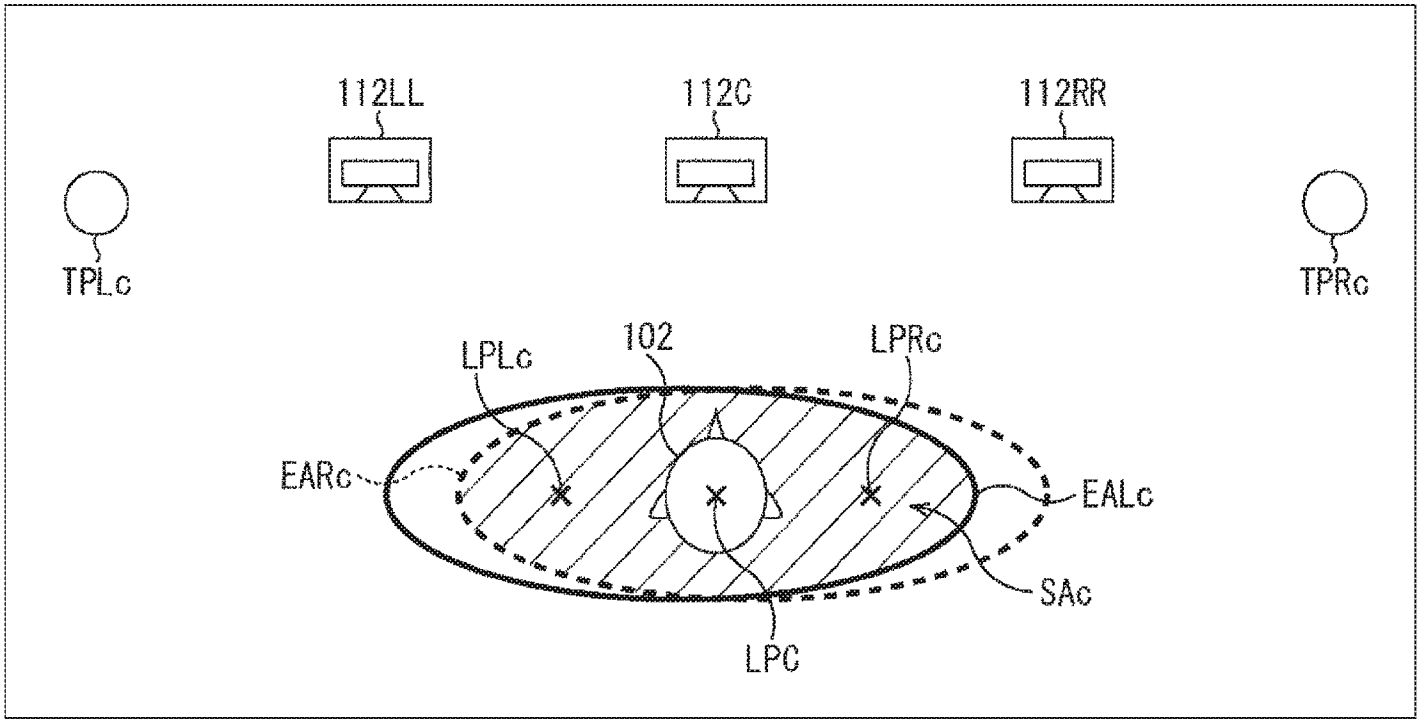
FIG. 13 illustrates an arrangement example of speakers.

Next, a third embodiment of the acoustic signal processing system to which the present technology is applied is described by referring to FIGS. 12 and 13.

FIG. 12 illustrates a functional configuration example of an acoustic signal processing system 401 as a third embodiment of the present technology. It is noted that the same reference signs are given to the constituent parts corresponding to those of FIG. 6, and the description of such constituent parts to which the processing similar to the processing of FIG. 6 is carried out is not repeated and appropriately skipped.

The acoustic signal processing system 401 differs from the acoustic signal processing system 101 of FIG. 6 in that an acoustic signal processing unit 411 is provided in place of the acoustic signal processing unit 111 and a speaker 112C is provided in place of the speakers 112LR, 112RL. The acoustic signal processing unit 411 differs from the acoustic signal processing unit 111 in that an output control unit 421 is provided in place of the output control unit 122. The output control unit 421 is configured to include an addition unit 431.

Similar to the output control unit 122 of FIG. 6, the output control unit 421 outputs the output signal SLLout supplied from the addition unit 153LL to the speaker 112LL, and outputs the output signal SRRout supplied from the addition unit 153RR to the speaker 112RR. Meanwhile, the addition unit 431 of the output control unit 421 adds the output signal SLRout supplied from the addition unit 153LR and the output signal SRLout supplied from the addition unit 153RL to generate an output signal SCout. The addition unit 431 outputs the output signal SCout to the speaker 112C.

The speaker 112LL outputs sound in accordance with the output signal SLLout. The speaker 112RR outputs sound in accordance with the output signal SRRout. The speaker 112C outputs sound in accordance with the output signal SCout.

FIG. 13 is an arrangement example of the speakers 112LL to 112RR. For example, the speakers 112LL to 112RR are arranged substantially linearly and laterally in front of the listening position LPC in the order of the speaker 112LL, the speaker 112C, and the speaker 112RR from the left. The speakers 112LL and 112RR are disposed on the same positions as illustrated in FIG. 7 described above. Meanwhile, the speaker 112C is disposed substantially in front of the listening position LPC. Moreover, a distance between the speakers 112LL and 112C is set substantially equal to a distance between the speakers 112C and 112RR.

Accordingly, the sound image of the sound from the speakers 112LL and 112C is localized at the target position TPLc with respect to the virtual listening position LPLc located on the left of the listening position LPC. The virtual listening position LPLc is located substantially in the center between the speakers 112LL and 112C in the lateral direction. The target position TPLc is located in front of and on the left of the virtual listening position LPLc and on the left of the speaker 112LL.

Moreover, the sound image of the sound from the speakers 112C and 112RR is localized at the target position TPRc with respect to the virtual listening position LPRc located on the right of the listening position LPC. The virtual listening position LPRc is located substantially in the center between the speakers 112C and 112RR in the lateral direction. The target position TPRc is located in front and on the right of the virtual listening position LPRc and on the right of the speaker 112RR.

Here, an effect area EALc of the target position TPLc is deflected to the side opposite to the target position TPLc with respect to the virtual listening position LPLc, such that the effect area EALc is narrower on the side of the target position TPLc and wider on the side opposite to the target position TPLc. Namely, the effect area EALc is narrower on the left of the virtual listening position LPLc and wider on the right of the virtual listening position LPLc. Meanwhile, the listening position LPC is located on the right of the virtual listening position LPLc, allowing the lateral deflection of the effect area EALc to be smaller at the listening position LPC than at the virtual listening position LPLc.

Meanwhile, an effect area EARc for the target position TPRc is deflected to the side opposite to the target position TPRc with respect to the virtual listening position LPRc, such that the effect area EARc is narrower on the side of the target position TPRc and wider on the side opposite to the target position TPRc. Namely, the effect area EARc is narrower on the right of the virtual listening position LPRc and wider in the left of the virtual listening position LPRc. Meanwhile, the listening position LPC is located on the left of the virtual listening position LPRc, allowing the lateral deflection of the effect area EARc to be smaller at the listening position LPC than at the virtual listening position LPRc.

Thus, the effect areas EALc and EARc overlap each other to generate an overlapped area which turns a service area SAc. The service area SAc is laterally wider and has a larger area than the service area SAa of FIG. 5. Therefore, if the listener 102 moves laterally to some extent from the listening position LPC, the listener 102 can remain in the service area SAc and the listener 13 feels that the sound image of the band of interest is located near the target positions TPLc and TPRc. As a result, the listener 13 can improve the localization feeling for the band of interest, although the number of speakers has been decreased.

It is noted that the acoustic signal processing system 401 can attain substantially similar effect as the acoustic signal processing system 101 when the speakers 112LR and 112RL substantially in front of the listening position LPC.

5. Fourth Embodiment

Figure 14:
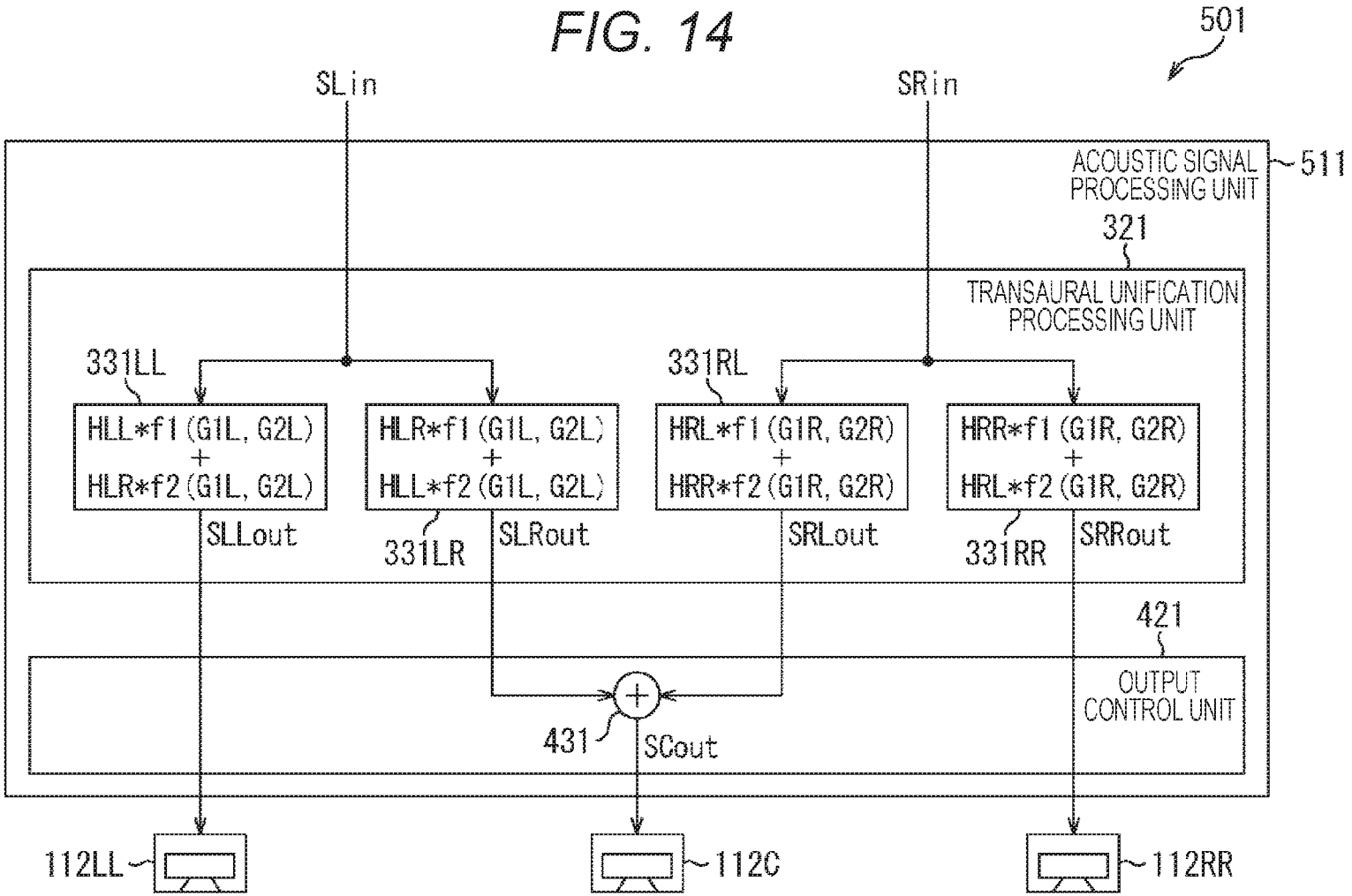
FIG. 14 is a block diagram illustrating a fourth embodiment of the acoustic signal processing system to which the present technology is applied.

Next, a fourth embodiment of the acoustic signal processing system to which the present technology is applied is described by referring to FIG. 14.

FIG. 14 illustrates a functional configuration example of an acoustic signal processing system 501 as a fourth embodiment of the present technology. It is noted that the same reference signs are given to the constituent parts corresponding to those of FIGS. 11 and 12, and the description of such constituent parts to which the processing same as the processing of FIGS. 11 and 12 is carried out is not repeated and appropriately skipped.

The acoustic signal processing system 501 differs from the acoustic signal processing system 401 of FIG. 12 in that an acoustic signal processing unit 511 is provided in place of the acoustic signal processing unit 411. The acoustic signal processing unit 511 differs from the acoustic signal processing unit 411 in that the transaural unification processing unit 321 of the acoustic signal processing system 301 of FIG. 11 is provided in place of the transaural processing unit 121.

Namely, the acoustic signal processing system 501 differs from the acoustic signal processing system 401 of FIG. 12 in that the transaural unification processing is carried out. Thus, it is expected that the acoustic signal processing system 501 can generally decrease the load of signal processing compared to the acoustic signal processing system 401.

6. Fifth Embodiment

Figure 15:
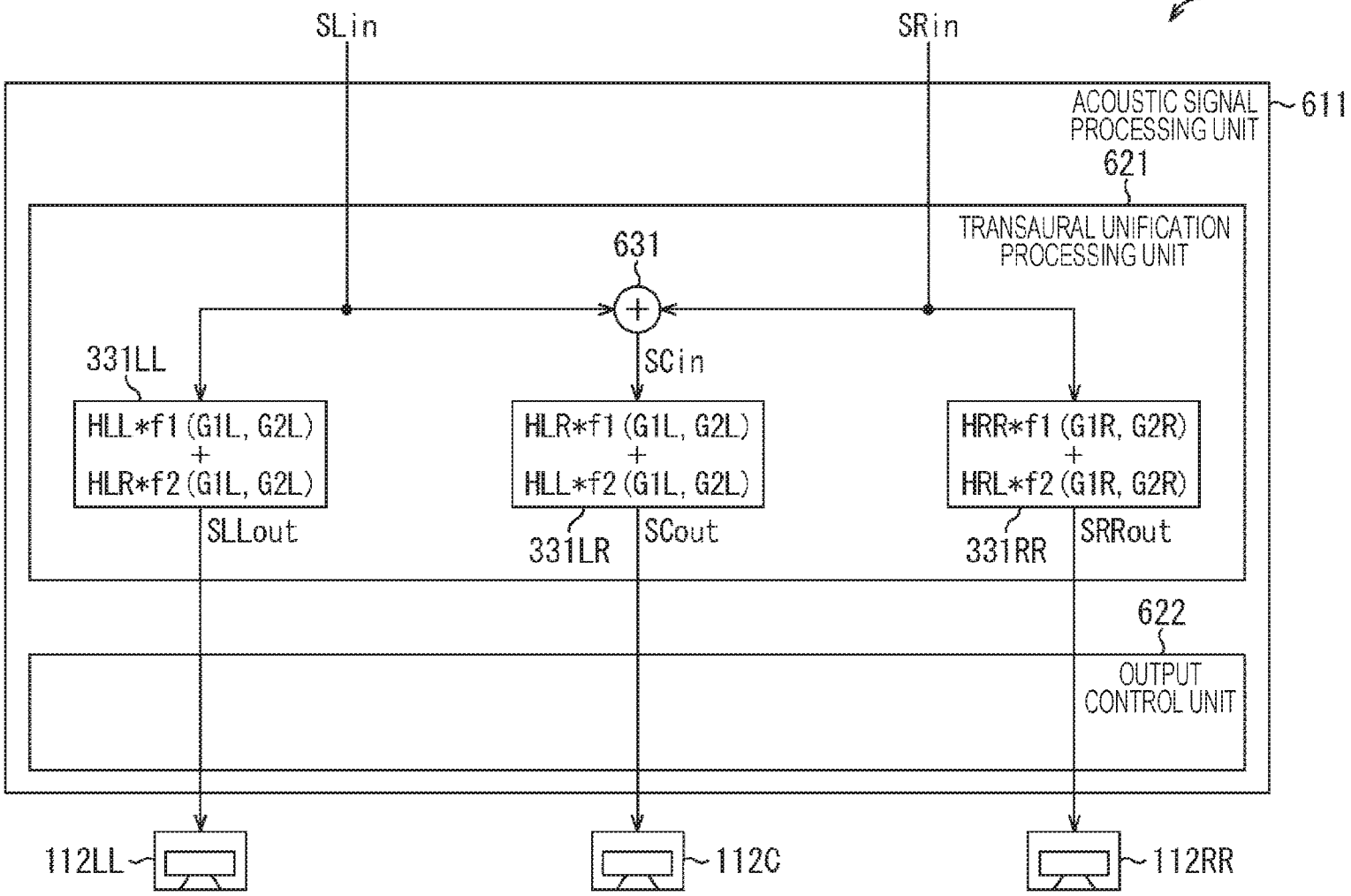
FIG. 15 is a block diagram illustrating a fifth embodiment of the acoustic signal processing system to which the present technology is applied.

Next, a fifth embodiment of the acoustic signal processing system to which the present technology is applied is described by referring to FIG. 15.

FIG. 15 illustrates a functional configuration example of an acoustic signal processing system 601 as a fifth embodiment of the present technology. It is noted that the same reference signs are given to the constituent parts corresponding to those of FIG. 14, and the description of such constituent parts subjected to processing same as the processing of FIG. 14 is not repeated and appropriately skipped.

The acoustic signal processing system 601 can be implemented as a modification example of the acoustic signal processing system 501 of FIG. 14 when Equations (9) to (12) below are satisfied.

$$\text{Head-related acoustic transfer function } HLL = \text{Head-related acoustic transfer function } HRR \tag{9}$$

$$\text{Head-related acoustic transfer function } HLR = \text{Head-related acoustic transfer function } HRL \tag{10}$$

$$\text{Head-related acoustic transfer function } G1L = \text{Head-related acoustic transfer function } G1R \tag{11}$$

$$\text{Head-related acoustic transfer function } G2L = \text{Head-related acoustic transfer function } G2R \tag{12}$$

Namely, when Equations (9) to (12) are satisfied, the acoustic signal processing units 331LR and 331RL of the acoustic signal processing system 501 carry out the same processing. The acoustic signal processing system 601, therefore, is configured to eliminate the signal processing unit 331RL from the acoustic signal processing system 501.

Specifically, the acoustic signal processing system 601 differs from the acoustic signal processing system 501 in that an acoustic signal processing unit 611 is provided in place of the acoustic signal processing unit 511. The acoustic signal processing unit 611 is configured to include a transaural unification processing unit 621 and an output control unit 622.

The transaural unification processing unit 621 differs from the transaural unification processing unit 321 of the acoustic signal processing system 501 in that an addition unit 631 is added and the signal processing unit 331RL is eliminated.

The addition unit 631 adds the acoustic signals SLin and SRin to generate an acoustic signal SCin. The addition unit 631 supplies the acoustic signal SCin to the signal processing unit 331LR.

The signal processing unit 331LR carries out the processing represented by Equation (6) above to the acoustic signal SCin to generate an output signal SCout. The output signal SCout is identical to the output signal SCout of the acoustic signal processing system 501. Namely, the processing represented by Equation (6) is simultaneously carried out on the acoustic signals SLin and SRin to generate the output signal SCout by mixing the output signals SLout and SLRout.

The output control unit 622 differs from the output control unit 421 of the acoustic signal processing system 501 in that the addition unit 431 is eliminated. Furthermore, the output control unit 622 outputs the output signals SLLout, SCout, and SRRout supplied from the transaural unification processing unit 621 to the speakers 112LL, 112C, and 112RR, respectively.

It is noted that the signal processing unit 331RL may be provided in place of the signal processing unit 331LR, because the signal processing units 331LR and 331RL carry out the same processing, as described above.

7. Modification Examples

A modification of the present technology described above is described below.

{Example of Modifying Positions of Speakers}

In the acoustic signal processing systems 101 and 301, the speakers 112LL to 112RR are not necessarily arranged linearly in the lateral direction and may be arranged, for example, in a staggered manner with each other in front of or behind the listening position LPC. Moreover, the speakers 112LL to 112RR may be arranged at different heights. Further, the distance between the speakers 112LL and 112LR may not necessarily be identical to the distance between the speakers 112RL and 112RR.

It is noted that acoustic design as well as the localization of the sound image at a predetermined position are easy when the speakers 112LL to 112RR are arranged substantially linearly in the lateral direction and the distance between the speakers 112LL and 112LR is substantially equal to the distance between the speakers 112RL and 112RR.

Moreover, all speakers 112LL to 112RR can be disposed behind the listening position LPC. In this case, the positional relationship of the speakers 112LL to 112RR in the lateral direction relative to the listening position LPC is similar to the case in which all speakers 112LL to 112RR are arranged in front of the listening position LPC.

Similarly, in the acoustic signal processing systems 401 to 601, the speakers 112LL to 112RR are not necessarily arranged linearly in the lateral direction and may be arranged, for example, in a staggered manner with each other in front of or behind the listening position LPC. Moreover, the speakers 112LL to 112RR may be arranged at different heights. Further, the distance between the speakers 112LL and 112C may not necessarily be equal to the distance between the speakers 112C and 112RR.

It is noted that acoustic design as well as the localization of the sound image at a predetermined position are easy when the speakers 112LL to 112RR are arranged substantially linearly in the lateral direction and the distance between the speakers 112LL and 112C is substantially equal to the distance between the speakers 112C and 112RR.

Moreover, all speakers 112LL to 112RR can be disposed behind the listening position LPC. In this case, the positional relationship of the speakers 112LL to 112RR in the lateral direction relative to the listening position LPC is similar to the case in which all speakers 112LL to 112RR are arranged in front of the listening position LPC. Thus, the speaker 112C, for example, is arranged substantially behind the listening position LPC.

{Example of Modifying Target Position}

Meanwhile, the target positions TPLb, TPRb of FIG. 7 are not necessarily arranged at positions bilaterally symmetric to the listening position LPC. Moreover, the target position TPLb can be arranged in front left of the virtual listening position LPLb and on the right of the speaker 112LL, or the target position TPRb can be arranged in front right of the virtual listening position LPRb and on the left of the speaker 112RR.

Moreover, the target position TPLb can be arranged behind the listening position LPC. Similarly, the target position TPRb can be arranged behind the listening position LPC. It is noted that it is also possible that one of the target positions TPLb, TPRb are disposed in front of the listening position LPC, while the other target position TPLb or TPRb is disposed behind the listening position LPC.

Similarly, the target positions TPLc, TPRc of FIG. 13 are not necessarily arranged at positions bilaterally symmetric to the listening position LPC. Moreover, it is also possible to arrange the target position TPLc in front left of the virtual listening position LPLc and on the right of the speaker 112LL, or arrange the target position TPRc in front right of the virtual listening position LPRc and on the left of the speaker 112RR.

Moreover, the target position TPLc can be disposed behind the listening position LPC. Similarly, the target position TPRc can be disposed behind the listening position LPC. It is noted that it is also possible that one of the target positions TPLc, TPRc are disposed in front of the listening position LPC, while the other target position TPLc or TPRc is disposed behind the listening position LPC.

{Band of Interest}

The band of interest varies depending on factors such as configuration and performance of the system, arrangement of speakers, or environments in which the system is installed. It is preferable, therefore, to set the band of interest by considering those factors. It is noted that it has been found experimentally that, when the system is the same, the band of interest tends to be wider as the distance between the pair of speakers becomes smaller.

Moreover, so far as the frequency band above the band of interest is concerned, it is preferable to expand the service area by a different method other than the method described above.

{Configuration Example of Computer}

A series of processing steps described above can be executed by hardware or can be executed by software. When the series of processing steps is executed by software, a program constituting the software is installed in a computer. Here, the computer includes a computer that is incorporated in dedicated hardware, a computer that can execute various functions by installing various programs, such as a general personal computer, and the like.

Figure 16:
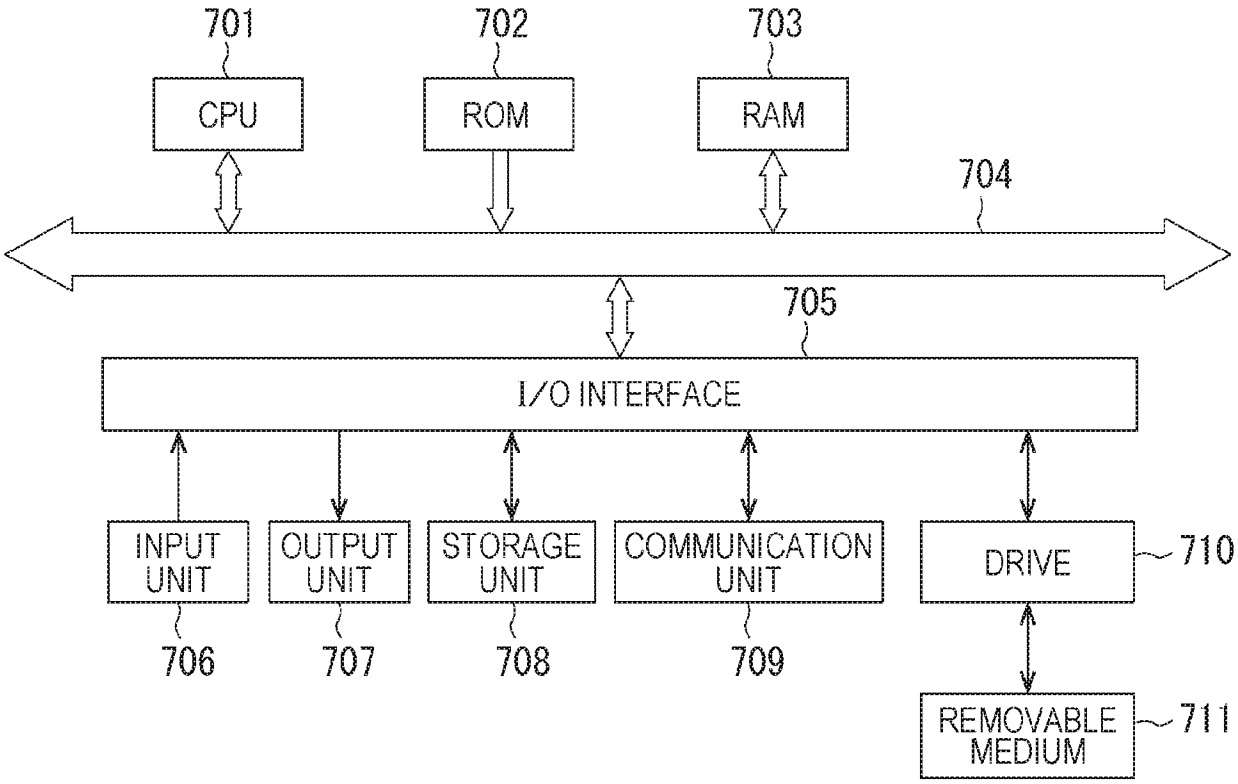
FIG. 16 is a block diagram illustrating a configuration example of a computer.

FIG. 16 is a block diagram illustrating a configuration example of hardware of a computer for executing the series of processing steps described above with a program.

In the computer, a central processing unit (CPU) 701, a read only memory (ROM) 702, and a random access memory (RAM) 703 are connected to one another via a bus 704.

An input/output interface 705 is further connected to the bus 704. To the input/output interface 705, an input unit 706, an output unit 707, a storage unit 708, a communication unit 709, and a drive 710 are connected.

The input unit 706 includes a keyboard, a mouse, a microphone, and the like. The output unit 707 includes a display, a speaker, and the like. The storage unit 708 includes a hard disk, a nonvolatile memory, and the like. The communication unit 709 includes a network interface and the like. The drive 710 drives a removable medium 711 such as a magnetic disk, an optical disk, a magneto-optical disk, or a semiconductor memory.

In the computer configured in the above manner, for example, the series of processing steps described above is carried out, for example, by the CPU 701 loading the program stored in the storage unit 708 to the RAM 703 via the input/output interface 705 and the bus 704 and executing the program.

The program executed by the computer (CPU 701) can be provided as a recorded media such as a removable medium 711 which is provided as a packaged medium. The program can also be provided via a wired or wireless transmission medium, such as a local area network, the Internet, or digital satellite broadcasting.

In the computer, the program can be installed in the storage unit 708 via the input/output interface 705 by inserting the removable medium 711 into the drive 710. Moreover, the program can be received by the communication unit 709 via a wired or wireless transmission medium and installed in the storage unit 708. Moreover, the program can be installed in advance in the ROM 702 or the storage unit 708.

It is noted that the program executed by the computer can be a program for which processing steps are carried out in a chronological order along a sequence described in this specification, or can be a program for which processing steps are carried out in parallel or at appropriate timing when called.

Moreover, in this specification, the system means a set of a plurality of constituent elements (devices, modules (parts), and the like), and it does not matter whether all the constituent elements are in the same casing. Therefore, both a plurality of devices accommodated in separate casings and connected via a network and a single device including a plurality of modules accommodated in a single casing are systems.

Further, embodiments of the present technology are not limited to the above-mentioned embodiments, but various changes may be made without departing from the spirit of the present technology.

For example, the present technology can adopt a cloud computing configuration in which a single function is processed by a plurality of devices via a network in a distributed and shared manner.

Moreover, the steps described in the above-mentioned flowchart can be executed by a single device or can be executed by a plurality of devices in a distributed manner.

Further, when a single step includes a plurality of processing steps, the plurality of processing steps included in the single step can be executed by a single device or can be executed by a plurality of devices in a distributed manner.

Moreover, it is noted that the present specification describes only an example effect not in a limiting manner, and an additional effect may also be provided.

Further, the present technology can adopt, for example, the following configurations.

(1)

An acoustic signal processing apparatus, including a transaural processing unit configured to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, the transaural processing unit configured to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position; and an output control unit configured to output the first output signal to the first speaker, output the second output signal to the second speaker, output the third output signal to the third speaker, and output the fourth output signal to the fourth speaker.

(2)

The acoustic signal processing apparatus according to (1), further including the first to fourth speakers.

(3)

The acoustic signal processing apparatus according to (2), in which a distance between the first and second speakers is substantially equal to a distance between the third and fourth speakers.

(4)

The acoustic signal processing apparatus according to (2) or (3), in which the first to fourth speakers are arranged substantially linearly in a lateral direction with respect to the listening position.

(5)

An acoustic signal processing method, including executing transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, and executing transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and executing output control to output the first output signal to the first speaker, output the second output signal to the second speaker, output the third output signal to the third speaker, and output the fourth output signal to the fourth speaker.

(6)

A program for causing a computer to execute transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and output control to output the first output signal to the first speaker, output the second output signal to the second speaker, output the third output signal to the third speaker, and output the fourth output signal to the fourth speaker.

(7)

An acoustic signal processing apparatus, including a transaural processing unit configured to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, the transaural processing unit configured to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and an output control unit configured to output the first output signal to the first speaker, output a mixed signal of the second output signal and the third output signal to the second speaker, and output the fourth output signal to the third speaker.

(8)

The acoustic signal processing apparatus according to (7), further including the first to third speakers.

(9)

The acoustic signal processing apparatus according to (8), in which a distance between the first and second speakers is substantially equal to a distance between the second and third speakers.

(10)

The acoustic signal processing apparatus according to (8) or (9), in which the first to third speakers are arranged substantially linearly in a lateral direction with respect to the listening position.

(11)

An acoustic signal processing method, including:

executing transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, executing transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and executing output control to output the first output signal to the first speaker, output a mixed signal of the second output signal and the third output signal to the second speaker, and output the fourth output signal to the third speaker.

(12)

A program for causing a computer to execute transaural processing to generate a first output signal for a left side speaker and a second output signal for a right side speaker by carrying out transaural processing on a first acoustic signal, the transaural processing including localizing a sound image from a first speaker disposed in a first direction in front of or behind the listening position and on the left of the listening position, and a sound image from a second speaker disposed in the first direction and on the right of the listening position, with respect to a first position located on the left of a predetermined listening position, in a second direction in front of or behind the first position and on the left of the first position, transaural processing to generate a third output signal for a left side speaker and a fourth output signal for a right side speaker by carrying out transaural processing on a second acoustic signal, the transaural processing including localizing a sound image from the third speaker disposed in the first direction and on the left of the listening position and disposed on the right of the first speaker, and a sound image from a fourth speaker disposed in the first direction of the listening position and on the right of the second speaker, with respect to a second position located on the right of the listening position, in a third direction in front of or behind the second position and on the right of the second position, and output control to output the first output signal to the first speaker, output a mixed signal of the second output signal and the third output signal to the second speaker, and output the fourth output signal to the third speaker.

(13)

An acoustic signal processing apparatus, including a first speaker disposed in a first direction in front of or behind a predetermined listening position and on the left of the listening position, a second speaker disposed in the first direction and on the right of the listening position, a third speaker disposed in the first direction and on the left of the listening position, and on the right of the first speaker, and a fourth speaker disposed in the first direction of the listening position and on the right of the second speaker, in which the acoustic signal processing apparatus generates a first output signal for a left side speaker and a second output signal for a right side speaker by carrying out transaural processing on a first acoustic signal, the transaural processing including localizing a sound image from sound from the first speaker and the second speaker, with respect to a first position located on the left of the listening position, in a second direction in front of or behind the first position and on the left of the first position, and outputs sound in accordance with the first output signal from the first speaker among the first output signal for the left side speaker and the second output signal for the right side speaker, outputs sound in accordance with the second output signal from the second speaker, generates a third output signal for a left side speaker and a fourth output signal for a right side speaker generated by carrying out transaural processing on a second acoustic signal, the transaural processing localizing a sound image from sound from the third speaker and the fourth speaker, with respect to a second position located on the right of the listening position, in a third direction in front of or behind the second position and on the right of the second position, and outputs sound in accordance with the third output signal from the third speaker among the third output signal for the left side speaker and the fourth output signal for the right side speaker, and outputs sound in accordance with the fourth output signal from the fourth speaker.

(14)

The acoustic signal processing apparatus according to (13), in which a distance between the first and second speakers is substantially equal to a distance between the third and fourth speakers.

(15)

The acoustic signal processing apparatus according to (13) or (14), in which the first to fourth speakers are arranged substantially linearly in a lateral direction with respect to the listening position.

(16)

An acoustic signal processing method, including disposing a first speaker in a first direction in front of or behind a predetermined listening position and on the left of the listening position, disposing a second speaker in the first direction and on the right of the listening position, disposing a third speaker in the first direction and on the left of the listening position, and on the right of the first speaker, and disposing a fourth speaker in the first direction of the listening position and on the right of the second speaker, generating a first output signal for a left side speaker and a second output signal for a right side speaker by carrying out transaural processing on a first acoustic signal, the transaural processing including localizing a sound image from sound from the first speaker and the second speaker, with respect to a first position located on the left of the listening position, in a second direction in front of or behind the first position and on the left of the first position, and outputting sound in accordance with the first output signal from the first speaker among the first output signal for the left side speaker and the second output signal for the right side speaker, outputting sound in accordance with the second output signal from the second speaker, generating a third output signal for a left side speaker and a fourth output signal for a right side speaker generated by carrying out transaural processing on a second acoustic signal, the transaural processing localizing a sound image from sound from the third speaker and the fourth speaker, with respect to a second position located on the right of the listening position, in a third direction in front of or behind the second position and on the right of the second position, and outputting sound in accordance with the third output signal from the third speaker among the third output signal for the left side speaker and the fourth output signal for the right side speaker, and outputting sound in accordance with the fourth output signal from the fourth speaker.

(17)

An acoustic signal processing apparatus, including a first speaker disposed in a first direction in front of or behind a predetermined listening position and on the left of the listening position, a second speaker disposed in the first direction of the listening position and substantially in front of or substantially behind the listening position, and a third speaker disposed in the first direction and on the right of the listening position, in which the acoustic signal processing apparatus generates a first output signal for a left side speaker and a second output signal for a right side speaker by carrying out ransaural processing on a first acoustic signal, the transaural processing including localizing a sound image from sound from the first speaker and the second speaker, with respect to a first position located on the left of the listening position, in a second direction in front of or behind the first position and on the left of the first position, and outputs sound in accordance with the first output signal from the first speaker among the first output signal for the left side speaker and the second output signal for the right side speaker, generates a third output signal for a left side speaker and a fourth output signal for a right side speaker generated by carrying out transaural processing on a second acoustic signal, the transaural processing localizing a sound image from sound from the second speaker and the third speaker, with respect to a second position located on the right of the listening position, in a third direction in front of or behind the second position and on the right of the second position, and outputs sound in accordance with the fourth output signal from the third speaker among the third output signal for the left side speaker and the fourth output signal for the right side speaker, and outputs sound in accordance with a mixed signal of the second output signal and the third output signal from the second speaker.

(18)

The acoustic signal processing apparatus according to (17), in which a distance between the first and second speakers is substantially equal to the distance between the second and third speakers.

(19)

The acoustic signal processing apparatus according to (17) or (18), in which the first to third speakers are arranged substantially linearly in a lateral direction with respect to the listening position.

(20)

An acoustic signal processing method, including disposing a first speaker in a first direction in front of or behind a predetermined listening position and on the left of the listening position, disposing a second speaker in the first direction of the listening position and substantially in front of or substantially behind the listening position, and disposing a third speaker in the first direction and on the right of the listening position, generating a first output signal for a left side speaker and a second output signal for a right side speaker by carrying out transaural processing on a first acoustic signal, the transaural processing including localizing a sound image from sound from the first speaker and the second speaker, with respect to a first position located on the left of the listening position, in a second direction in front of or behind the first position and on the left of the first position, and outputting sound in accordance with the first output signal from the first speaker among the first output signal for the left side speaker and the second output signal for the right side speaker, generating a third output signal for a left side speaker and a fourth output signal for a right side speaker generated by carrying out transaural processing on a second acoustic signal, the transaural processing localizing a sound image from sound from the second speaker and the third speaker, with respect to a second position located on the right of the listening position, in a third direction in front of or behind the second position and on the right of the second position, and outputting sound in accordance with the fourth output signal from the third speaker among the third output signal for the left side speaker and the fourth output signal for the right side speaker, and outputting sound in accordance with a mixed signal of the second output signal and the third output signal from the second speaker.

REFERENCE SIGNS LIST

101 Acoustic signal processing system
102 Listener
111 Acoustic signal processing unit
112LL to 112RR, 112C Speaker
121 Transaural processing unit
122 Output control unit
131 Binauralization processing unit
132 Crosstalk compensation processing unit
141LL to 141RR Binaural signal generating unit
151LL to 151RR, 152LL to 152RR Signal processing unit
153LL to 153RR Addition unit
201 Casing
211C, 211L1 to 211L3, 211R1 to 211R3 Speaker
212L, 212R Tweeter
301 Acoustic signal processing system
311 Acoustic signal processing unit
321 Transaural unification processing unit
331LL to 331RR Signal processing unit
401 Acoustic signal processing system
411 Acoustic signal processing unit
421 Output control unit
431 Addition unit
501 Acoustic signal processing system
511 Acoustic signal processing unit
601 Acoustic signal processing system
611 Acoustic signal processing unit
621 Transaural unification processing unit
622 Output control unit
631 Addition unit
LPa, LPC Listening position
LPLb, LPLc, LPRb, LPRc Virtual listening position
TPLa to TPLc, TPRa to TPRc Target position
EALa to EALc, EARa to EARc Effect area
SAa to SAc Service area

The invention claimed is:

1. An acoustic signal processing apparatus, comprising:
a central processing unit (CPU) configured to:
execute transaural processing on a first acoustic signal, wherein the transaural processing on the first acoustic signal comprises localization of a sound image of sounds from a first speaker and from a second speaker at a first position, wherein
the first position is on a left of a listening position and a left of the first speaker,
the first speaker is on the left of the listening position and one of in front of the listening position or behind the listening position, and
the second speaker is on a right of the listening position;
execute the transaural processing on a second acoustic signal, wherein the transaural processing on the second acoustic signal comprises localization of a sound image of sounds from a third speaker and from a fourth speaker at a second position, wherein
the second position is on the right of the listening position,
the third speaker is on the left of the listening position and on a right of the first speaker,
the second position is on a right of the fourth speaker,
the fourth speaker is on a right of the second speaker, and
the first speaker, the second speaker, the third speaker, and the fourth speaker are associated with a same area that includes the listening position;
generate a first output signal for the first speaker and a second output signal for the second speaker, based on the transaural processing on the first acoustic signal;
generate a third output signal for the third speaker and a fourth output signal for the fourth speaker, based on the transaural processing on the second acoustic signal;
output the first output signal to the first speaker;
output the second output signal to the second speaker;
output the third output signal to the third speaker; and
output the fourth output signal to the fourth speaker.

2. The acoustic signal processing apparatus according to claim 1, further comprising the first speaker, the second speaker, the third speaker, and the fourth speaker.

3. The acoustic signal processing apparatus according to claim 2, wherein a distance between the first speaker and the second speaker is substantially equal to a distance between the third speaker and the fourth speaker.

4. The acoustic signal processing apparatus according to claim 2, wherein the first speaker, the second speaker, the third speaker, and the fourth speaker are arranged substantially linearly in a lateral direction with respect to the listening position.

5. An acoustic signal processing method, comprising:
executing transaural processing on a first acoustic signal, wherein the transaural processing on the first acoustic signal comprises localization of a sound image of sounds from a first speaker and from a second speaker at a first position, wherein
the first position is on a left of a listening position and a left of the first speaker,
the first speaker is on the left of the listening position and one of in front of the listening position or behind the listening position, and
the second speaker is on a right of the listening position;
executing the transaural processing on a second acoustic signal, wherein the transaural processing on the second acoustic signal comprises localization of a sound image of sounds from a third speaker and from a fourth speaker at a second position, wherein
the second position is on the right of the listening position,
the third speaker is on the left of the listening position and on a right of the first speaker,
the second position is on a right of the fourth speaker,
the fourth speaker is on the right of the listening position and on a right of the second speaker, and
the first speaker, the second speaker, the third speaker, and the fourth speaker are associated with a same area that includes the listening position;
generating a first output signal for the first speaker and a second output signal for the second speaker, based on the transaural processing on the first acoustic signal;
generating a third output signal for the third speaker and a fourth output signal for the fourth speaker, based on the transaural processing on the second acoustic signal;
outputting the first output signal to the first speaker;
outputting the second output signal to the second speaker;
outputting the third output signal to the third speaker; and
outputting the fourth output signal to the fourth speaker.

6. A non-transitory computer-readable medium having stored thereon computer-executable instructions, which when executed by a processor of an acoustic signal processing apparatus, cause the processor to execute operations, the operations comprising:

executing transaural processing on a first acoustic signal, wherein the transaural processing on the first acoustic signal comprises localization of a sound image of sounds from a first speaker and from a second speaker at a first position, wherein the first position is on a left of a listening position and a left of the first speaker, the first speaker is on the left of the listening position and one of in front of the listening position or behind the listening position, and the second speaker is on a right of the listening position;

executing the transaural processing on a second acoustic signal, wherein the transaural processing on the second acoustic signal comprises localization of a sound image of sounds from a third speaker and from a fourth speaker at a second position, wherein the second position is on the right of the listening position, the third speaker is on the left of the listening position and on a right of the first speaker, the second position is on a right of the fourth speaker, the fourth speaker is on the right of the listening position and on a right of the second speaker, and the first speaker, the second speaker, the third speaker, and the fourth speaker are associated with a same area that includes the listening position;

generating a first output signal for the first speaker and a second output signal for the second speaker, based on the transaural processing on the first acoustic signal;

generating a third output signal for the third speaker and a fourth output signal for the fourth speaker, based on the transaural processing on the second acoustic signal;

outputting the first output signal to the first speaker;

outputting the second output signal to the second speaker;

outputting the third output signal to the third speaker; and outputting the fourth output signal to the fourth speaker.

7. An acoustic signal processing apparatus, comprising:

a first speaker on a left of a listening position and one of in front of the listening position or behind the listening position;

a second speaker on a right of the listening position;

a third speaker on the left of the listening position, and on a right of the first speaker;

a fourth speaker on the right of the listening position and on a right of the second speaker; and a central processing apparatus (CPU) configured to:

execute transaural processing on a first acoustic signal, wherein the transaural processing on the first acoustic signal comprises localization of a sound image of sounds from the first speaker and from the second speaker at a first position, wherein the first position is on the left of the listening position and a left of the first speaker;

execute the transaural processing on a second acoustic signal, wherein the transaural processing on the second acoustic signal comprises localization of a sound image of sounds from the third speaker and from the fourth speaker at a second position, wherein the second position is on the right of the listening position, the second position is on a right of the fourth speaker, and the first speaker, the second speaker, the third speaker, and the fourth speaker are associated with a same area that includes the listening position;

generate a first output signal for the first speaker and a second output signal for the second speaker, based on the transaural processing on the first acoustic signal;

output sound based on the first output signal from the first speaker;

output sound based on the second output signal from the second speaker;

generate a third output signal for the third speaker and a fourth output signal for the fourth speaker, based on the transaural processing on the second acoustic signal;

output sound based on the third output signal from the third speaker; and output sound based on the fourth output signal from the fourth speaker.

8. The acoustic signal processing apparatus according to claim 7, wherein a distance between the first speaker and the second speaker is substantially equal to a distance between the third speaker and the fourth speaker.

9. The acoustic signal processing apparatus according to claim 7, wherein the first speaker, the second speaker, the third speaker, and the fourth speaker are arranged substantially linearly in a lateral direction with respect to the listening position.

10. An acoustic signal processing method, comprising:

executing transaural processing on a first acoustic signal, wherein the transaural processing on the first acoustic signal comprises localization of a sound image of sounds from a first speaker and from a second speaker at a first position, wherein the first position is on a left of a listening position and a left of the first speaker, the first speaker is on the left of the listening position and one of in front of the listening position or behind the listening position, and the second speaker is on a right of the listening position;

executing the transaural processing on a second acoustic signal, wherein the transaural processing on the second acoustic signal comprises localization of sounds image of sounds from a third speaker and from a fourth speaker at a second position, wherein the second position is on the right of the listening position, the third speaker is on the left of the listening position and on a right of the first speaker, the second position is on a right of the fourth speaker, the fourth speaker is on the right of the listening position and on a right of the second speaker, and the first speaker, the second speaker, the third speaker, and the fourth speaker are associated with a same area that includes the listening position;

generating a first output signal for the first speaker and a second output signal for the second speaker, based on the transaural processing on the first acoustic signal;

outputting sound based on the first output signal from the first speaker;

outputting sound based on the second output signal from the second speaker, generating a third output signal for the third speaker and a fourth output signal for the fourth speaker, based on the transaural processing on the second acoustic signal;

outputting sound based on the third output signal from the third speaker; and outputting sound based on the fourth output signal from the fourth speaker.

* * * * *